US006483475B1

(12) United States Patent
Tokuda

(10) Patent No.: US 6,483,475 B1
(45) Date of Patent: Nov. 19, 2002

(54) BLOCK-DOWN-CONVERTER AND MULTI-BEAM-ANTENNA

(75) Inventor: Katsuhiko Tokuda, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/600,627

(22) PCT Filed: Aug. 7, 1998

(86) PCT No.: PCT/JP98/03519

§ 371 (c)(1),
(2), (4) Date: Sep. 8, 2000

(87) PCT Pub. No.: WO99/38228

PCT Pub. Date: Jul. 29, 1999

(30) Foreign Application Priority Data

Jan. 22, 1998 (JP) ..... 10-010196

(51) Int. Cl.[7] ..... H01Q 13/00
(52) U.S. Cl. ..... 343/786; 343/781 R
(58) Field of Search ..... 343/786, 781 R, 343/776, 840, 756, 772, 909; H01Q 13/00

(56) References Cited

U.S. PATENT DOCUMENTS

| | | | | |
|---|---|---|---|---|
| 4,757,324 A | * | 7/1988 | Dhanjal | 343/776 |
| 5,113,197 A | * | 5/1992 | Luh | 343/776 |
| 5,426,442 A | * | 6/1995 | Haas | 343/778 |
| 5,486,839 A | * | 1/1996 | Rodeffer et al. | 343/786 |
| 5,812,096 A | * | 9/1998 | Tilford | 343/781 R |
| 6,166,704 A | * | 12/2000 | Jan et al. | 343/840 |

FOREIGN PATENT DOCUMENTS

| | | |
|---|---|---|
| JP | 56-141603 | 11/1981 |
| JP | 58-185409 | 10/1984 |
| JP | 63-184406 | 7/1988 |
| JP | 3-155203 | 7/1991 |
| JP | 3-107810 | 11/1991 |
| JP | 4-150602 | 5/1992 |
| JP | 6-69722 | 3/1994 |
| JP | 6-52217 | 7/1994 |
| JP | 9-36655 | 2/1997 |
| JP | 10-145138 | 5/1998 |
| JP | 11-17440 | 1/1999 |

* cited by examiner

*Primary Examiner*—Don Wong
*Assistant Examiner*—Trinh Vo Dinh
(74) *Attorney, Agent, or Firm*—Wenderoth, Lind & Ponack, L.L.P.

(57) ABSTRACT

A multi-beam antenna includes a parabolic reflector, a block-down-converter, a support arm and a holding member. The block-down-converter is arranged such that a multi-primary radiator and a housing containing a conversion circuit are integrally molded. The multiprimary radiator is constituted by a plurality of primary radiators having apertures whose central points are arranged linearly. Neighboring two of the primary radiators are integrally joined with each other at a joint part. A polarization angle can be adjusted simply by a function that an angle formed between the block-down-converter and the support arm can be varied about a perpendicular radiation axis by the holding member. A feeding element pair formed on the conversion circuit is constituted by two feeding elements extending orthogonally to each other. Angles formed between the feeding elements and a central line of the joint part are determined on the basis of a center of a longitudinal range of a receiving area.

19 Claims, 22 Drawing Sheets

BLOCK-DOWN-CONVERTER AND MULTI-BEAM-ANTENNA

BACKGROUND OF THE INVENTION

1. Technical Field

The present invention relates to a parabolic antenna for use in satellite broadcasting or satellite communication and more particularly, to a primary radiator and a block-down-converter which constitute the parabolic antenna.

2. Background Art

Conventionally, parabolic antennas which receive radio waves from a plurality of stationary satellites by a single reflector are referred to as "dual-beam antennas" or "multi-beam antennas" and are mainly adapted to receive radio waves from two satellites located on a stationary orbit with a difference of longitude of 8 degrees.

One example of the parabolic antennas is proposed in Japanese Utility Model Laid-Open Publication No. 3-107810 (1991) and FIG. 27 is a perspective view showing its arrangement. In FIG. 27, a dual-beam antenna 100 includes primary radiators 102 and 103 constituting a double primary radiator and a reflector 101. The primary radiators 102 and 103 and the reflector 101 are coupled with each other by a support arm 104 so as to have a predetermined positional relationship. Radio waves from first and second satellites are reflected by the reflector 101 so as to be, respectively, received by the primary radiators 102 and 103. In this dual-beam antenna, axes of the primary radiators are disposed so as to extend horizontally at the time of reception.

Meanwhile, circular polarization is employed as polarization in satellite broadcasting, while linear polarization of two kinds, i.e., in vertical and horizontal directions is employed as polarization in satellite communication. Therefore, radio waves from a communication satellite contain a polarization angle dependent on a receiving point and thus, this polarization angle should be adjusted.

A method of adjusting the polarization angle is proposed in Japanese Utility Model Laid-Open Publication No. 6-52217 (1994). FIG. 28 is a perspective view indicative of one example of adjustment of the polarization angle. As shown in FIG. 28, the adjustment is performed by rotating an arm 113 through an angle θb about an axis of a fixed primary radiator 111 and further, rotating a primary radiator 112 through an angle θa about its own axis.

FIG. 29 a relationship between antenna diameter D and primary radiator spacing L in the case where difference of longitude between two satellites on a station orbit is 8 degrees and 4 degrees. As shown in FIG. 29, the reflector diameter D and the primary radiator spacing L are substantially proportional to each other and an optimum value of the primary radiator spacing at the time the difference of longitude is 4 degrees is smaller than that at the time the difference of longitude is 8 degrees.

FIG. 30 shows a relationship between aperture diameter d of a primary radiator and antenna efficiency η in a single-beam antenna. As shown in FIG. 30, when the aperture diameter d assumes $d_{opt}$, the antenna efficiency η reaches a maximum $\eta_{max}$ as follows. If the aperture diameter is small, radiation range over the reflector increases and thus, energy of the reflector spills from the reflector, namely, spill-over happens. On the other hand, if the aperture diameter is large excessively, radiation range decreases and thus, an edge portion of the reflector does not work.

Therefore, in case a dual-beam antenna for receiving radio waves from two satellites with a difference of longitude of 4 degrees is formed by using an antenna having a diameter Do and primary radiators having an optimum aperture diameter $d_{opt}$, the spacing Lo should be larger than $d_{opt}$. As shown in FIG. 29, in case a dual-beam antenna is formed by using a reflector having a smaller effective diameter Ds, the spacing L decreases to Ls. If the spacing Ls is smaller than $d_{opt}$, the aperture diameter d necessarily becomes smaller than $d_{opt}$ yielding the maximum efficiency $\eta_{max}$, so that the antenna efficiency η drops markedly to $\eta_o$ as shown in FIG. 30 and thus, it becomes difficult to obtain desired reception performance.

SUMMARY OF THE INVENTION

In order to obviate the above mentioned drawbacks, a double primary radiator of the present invention has a construction in which by using a small-diameter parabolic reflector having an effective diameter of, for example, 45 cm, two primary radiators are integrally joined with each other so as to receive radio waves from two satellites having a difference of longitude of, for example, 4 degrees.

In the double primary radiator of the present invention, since apertures of the primary radiators are arranged to face each other inwardly, it is possible to compensate for reduction of radiation area due to defocus caused in the case where a dual-beam antenna is arranged such that a central point of a joint part of the double primary radiators is located in the vicinity of a focal point of the reflector.

Since a block-down-converter of the present invention can be rotated as a whole about a perpendicular radiation axis, tilt angle of the two radiators can be adjusted relative to polarization angle at a time.

In the block-down-converter of the present invention, if an initial shift angle for adjusting polarization angle is set to that of a point located substantially at a center of a longitudinal range of a receiving area, adjustment of the initial shift angle can be substantially optimized throughout the receiving area. Therefore, since it is not necessary to adjust the initial shift angle for each receiving point, the block-down-converters can be mass produced.

Meanwhile, since the block-down-converter of the present invention has a construction in which a double primary radiator and a housing containing a conversion circuit for performing amplification and frequency conversion of received radio waves are integrally molded, the block-down-converter can be produced by a simple process such as injection molding employing a die, thereby resulting in a reduced production cost.

DESCRIPTION OF THE PREFERRED EMBODIMENTS

First Embodiment

Figure 1:
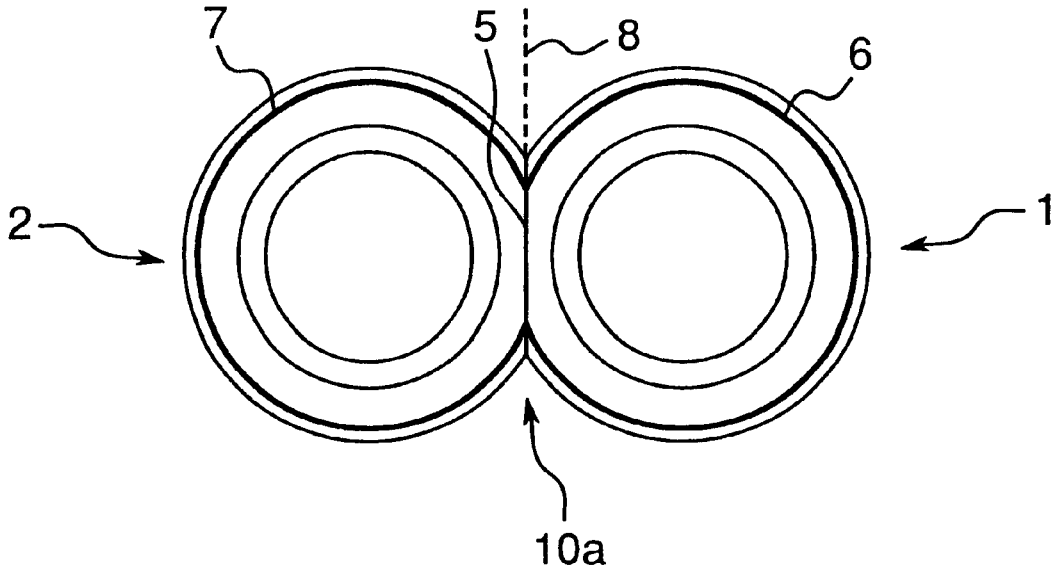
FIG. 1 is a front elevational view of a double primary radiator according to a first embodiment of the present invention.
Figure 2:
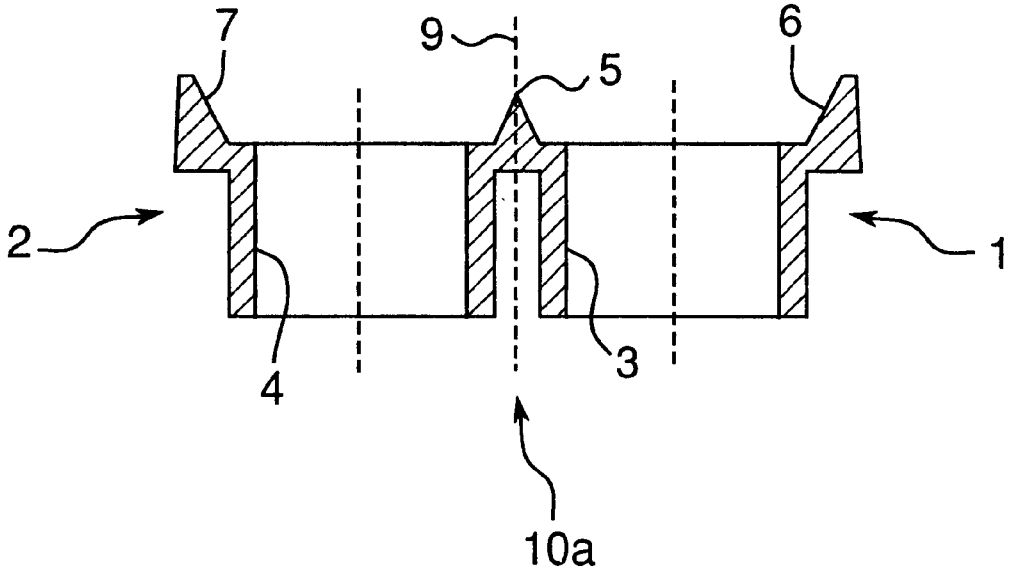
FIG. 2 is a sectional view of the double primary radiator according to the first embodiment of the present invention.

Hereinafter, double primary radiators according to embodiments of the present invention are described with reference to the drawings. FIGS. 1 and 2 are a front elevational view and a sectional view of a double primary radiator according to a first embodiment of the present invention, respectively. As shown if FIGS. 1 and 2, a double primary radiator 10*a* is constituted by primary radiators 1 and 2. The primary radiator 1 is constituted by a feed horn 6 and a circular waveguide 3, while the primary radiator 2 is constituted by a feed horn 7 and a circular waveguide 4. The feed horns 6 and 7 are each provided with a tapered shape at an outer periphery of an aperture of the primary radiator and are excised partially so as to have cutoff portions, respectively. A joint part 5 is formed by joining these two cutoff portions with each other.

Hereinafter, an end face of the waveguide adjacent to the aperture is referred to as an "aperture face" of the primary radiator. A middle point of a segment connecting centers of the two apertures, namely, a central point in the joint part is referred to as a "central point of the joint part", while a perpendicular bisector 8 of the segment connecting the centers of the two apertures is referred to as a "central line of the joint part".

In this embodiment, an aperture face of the primary radiator 1 and an aperture face of the primary radiator 2 are formed in an identical plane as shown in FIG. 2. Meanwhile, a straight line 9 passing through the central point of the joint part and running parallel with axes of the two primary radiators is defined as a "perpendicular radiation axis" of the double primary radiator 10*a*.

Second Embodiment

Figure 3:
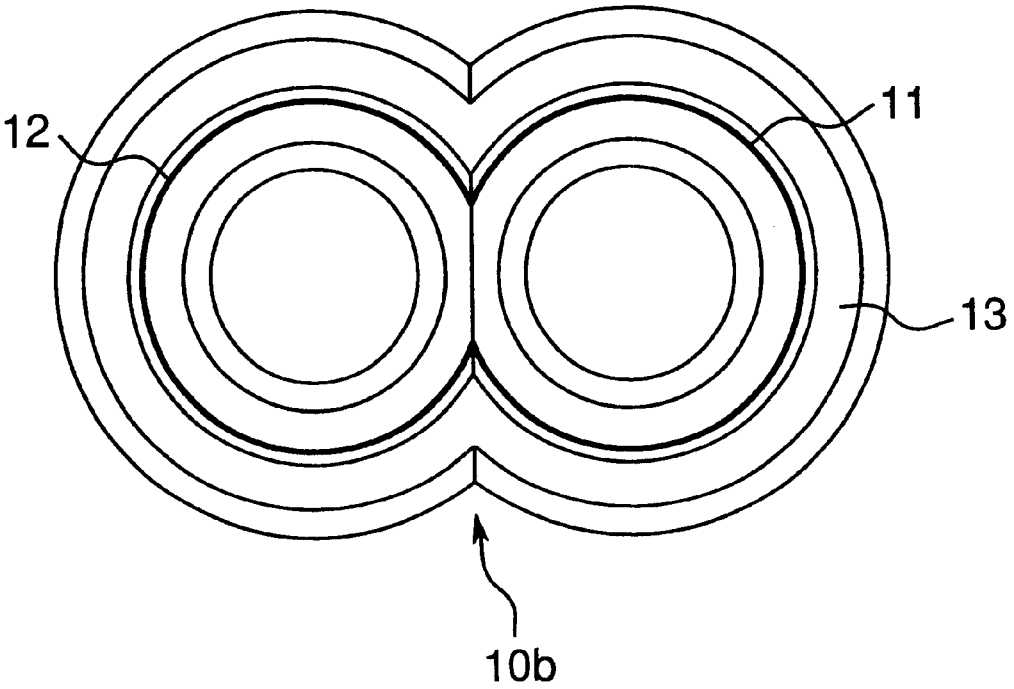
FIG. 3 is a front elevational view of a double primary radiator according to a second embodiment of the present invention.
Figure 4:
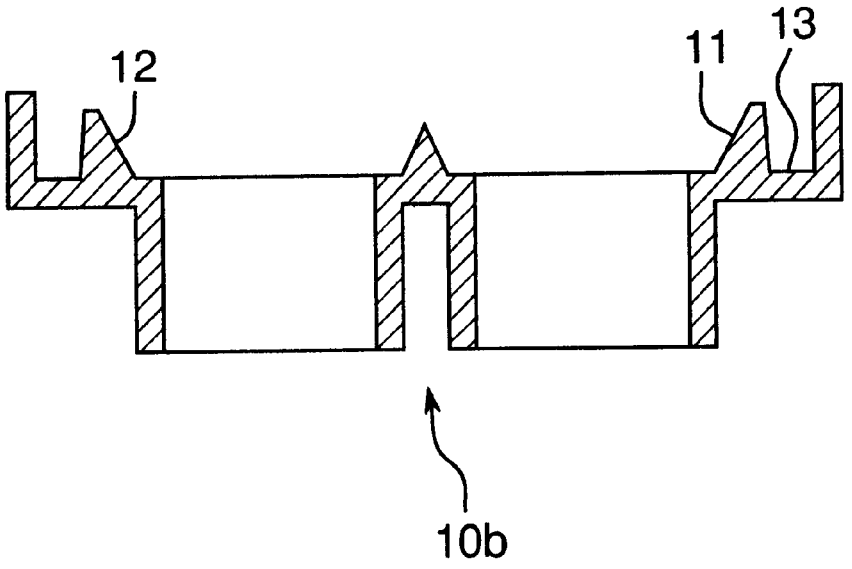
FIG. 4 is a sectional view of the double primary radiator according to the second embodiment of the present invention.

FIGS. 3 and 4 are a front elevational view and a sectional view of a double primary radiator according to a second embodiment of the present invention, respectively. In the same manner as the double primary radiator 10*a* of the first embodiment, a double primary radiator 10*b* of this embodiment has feed horns and circular waveguides. At an outer periphery of each of feed horns 11 and 12, the double primary radiator 10*b* further includes a groove portion 13 formed by an annular groove having a predetermined width and a predetermined depth. The groove portions 13 are likewise coupled with each other in the vicinity of a joint part for joining the feed horns 11 and 12. The groove portions lessen the influence of excision of the feed horns at the joint part and thus, can improve performances such as antenna efficiency, antenna directivity, beam separation degree corresponding to an angle for viewing two satellites, etc.

Figure 5:
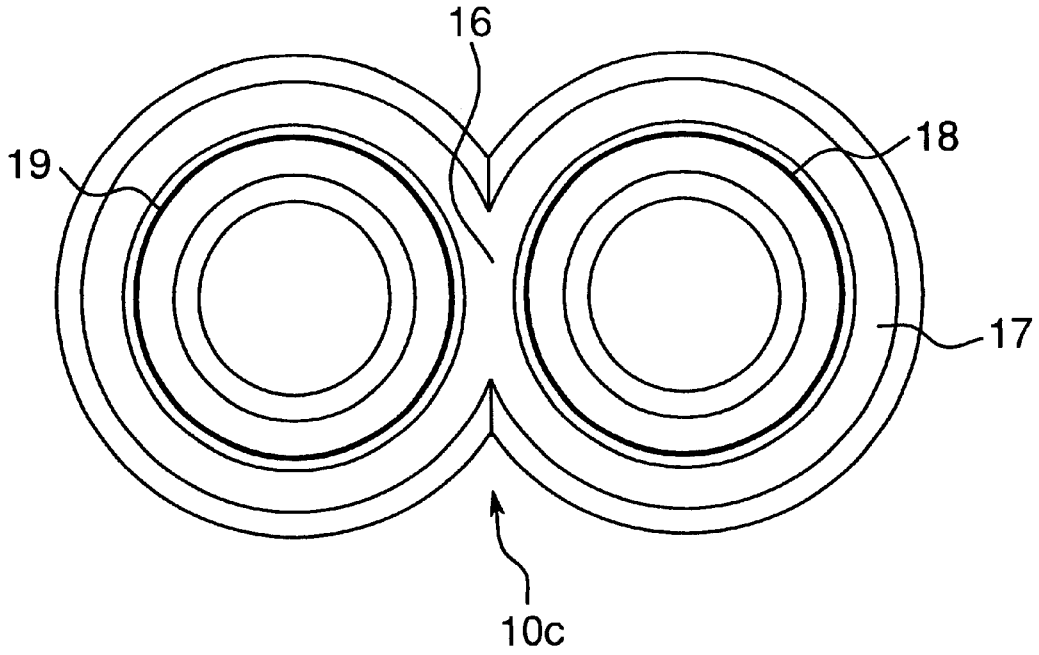
FIG. 5 is a front elevational view of a further double primary radiator according to the second embodiment of the present invention.
Figure 6:
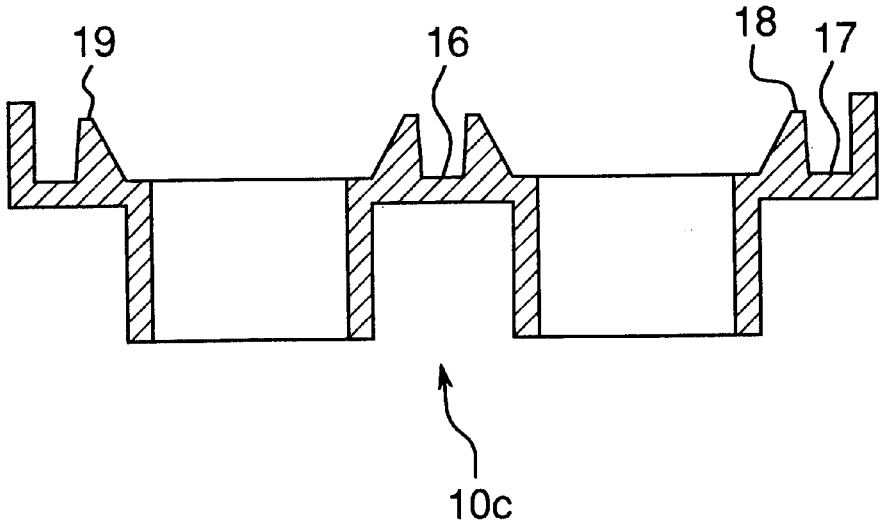
FIG. 6 is a sectional view of the further double primary radiator according to the second embodiment of the present invention.

A double primary radiator 10*c* shown in a front elevational view of FIG. 5 and a sectional view of FIG. 6 has feed horns and circular waveguides in the same manner as the double primary radiator 10*b*. However, in this embodiment, feed horns 18 and 19 are not coupled with each other and only groove portions 17 are coupled with each other at a joint part 16.

By using a parabolic reflector having an effective diameter of about 45 cm, the double primary radiator having such an arrangement is used for receiving radio waves from two satellites located with a difference of longitude of 8 degrees.

Figure 7:
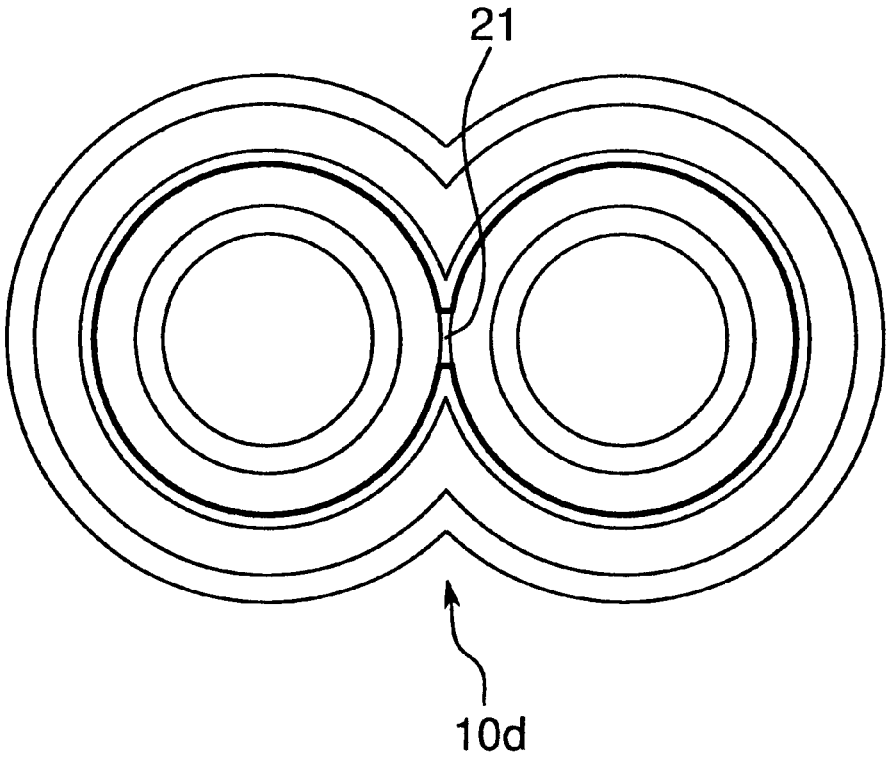
FIG. 7 is a front elevational view of a still further double primary radiator according to the second embodiment of the present invention.
Figure 8:
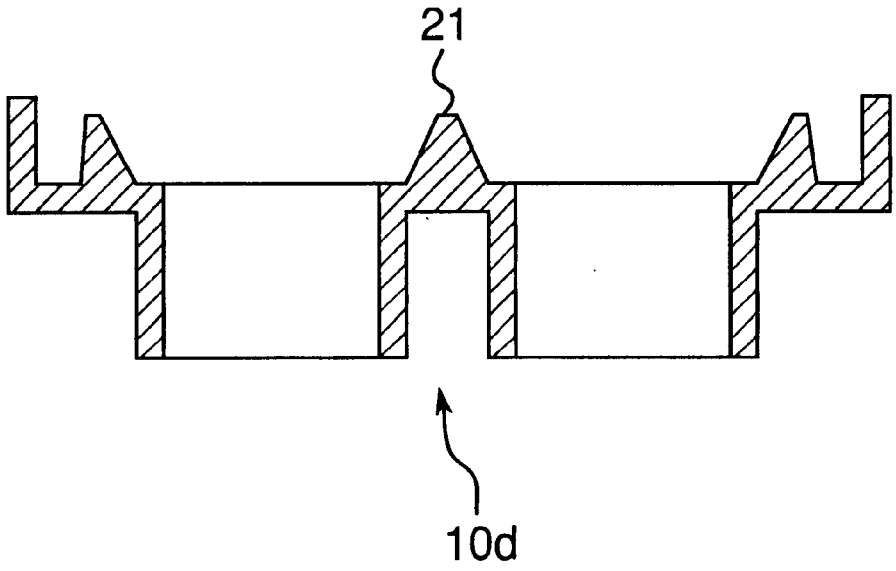
FIG. 8 is a sectional view of the still further double primary radiator according to the second embodiment of the present invention.

FIGS. 7 and 8 are a front elevational view and a sectional view of a double primary reflector 1*d*, respectively. As shown in FIGS. 7 and 8, two feed horns may come into contact with each other at a joint part 21 according to diameter of a reflector.

Third Embodiment

Figure 9:
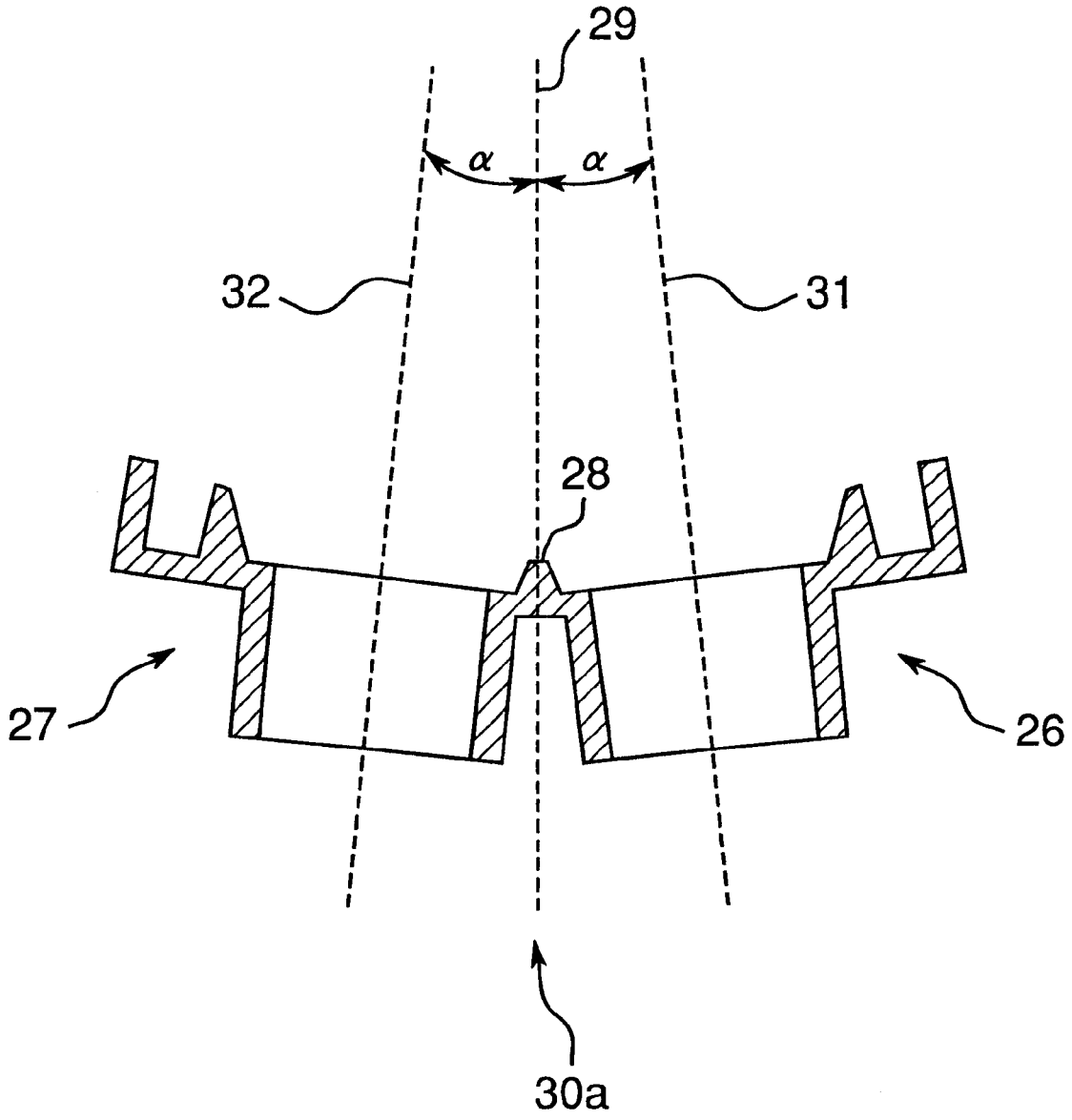
FIG. 9 is a sectional view of a double primary radiator according to a third embodiment of the present invention.

FIG. 9 is a sectional view of a double primary radiator 30*a* according to a third embodiment of the present invention. As shown in FIG. 9, the double primary radiator 30*a* is constituted by constituent elements similar to those of the double primary radiator 10*b* of the second embodiment. The double primary radiator 30*a* is different from the double primary radiator 10*b* in that a waveguide axis 31 passing through a center of an aperture face of a primary radiator 26 perpendicularly to this aperture face and a waveguide axis 32 passing through a center of an aperture face of a primary radiator 27 perpendicularly to this aperture face form a predetermined angle as shown in FIG. 9. Namely, the waveguide axes 31 and 32 have a point of intersection (not shown).

In this embodiment, a straight line 29 connecting this point of intersection and a central point of a joint part acts as a perpendicular radiation axis of the double primary radiator 30*a*. Each of an angle formed between the waveguide axis 31 and the perpendicular radiation axis 29 and an angle formed between the waveguide axis 32 and the perpendicular radiation axis 29 is $\alpha$.

Figure 10:
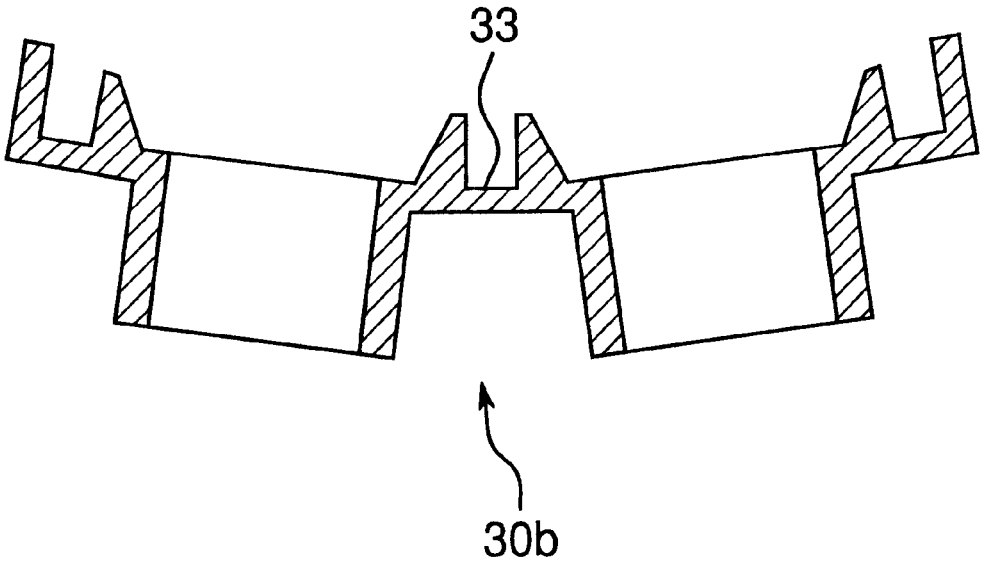
FIG. 10 is a sectional view of a further double primary radiator according to the third embodiment of the present invention.

In an example of a double primary radiator 30*b* shown in FIG. 10, two primary radiators are formed such that two waveguide axes have a point of intersection in the double primary radiator 10*c* and only groove portions are coupled with each other at a joint part 33. In an example of a double primary radiator 30*c* shown in FIG. 11, two primary radiators are formed such that two waveguide axes have a point of intersection in the double primary radiator 30*c* and feed horns are coupled with each other at a joint part 34.

In the double primary radiator of this embodiment, since apertures of the two primary radiators face each other inwardly, excellent reception performance can be obtained.

Fourth Embodiment

Figure 12:
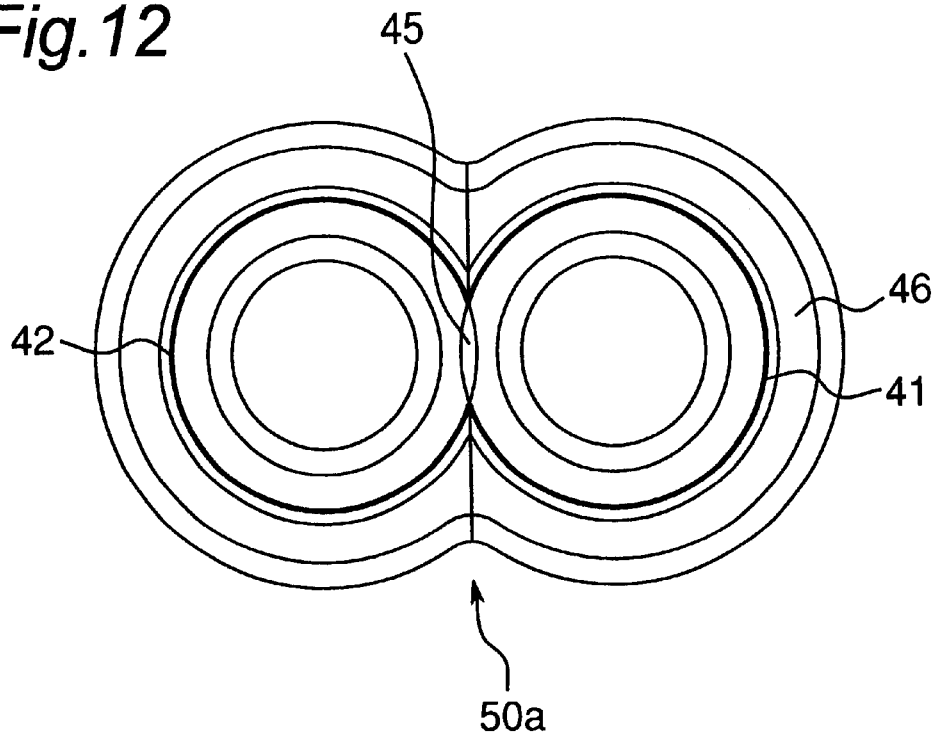
FIG. 12 is a front elevational view of a double primary radiator according to a fourth embodiment of the present invention.
Figure 13:
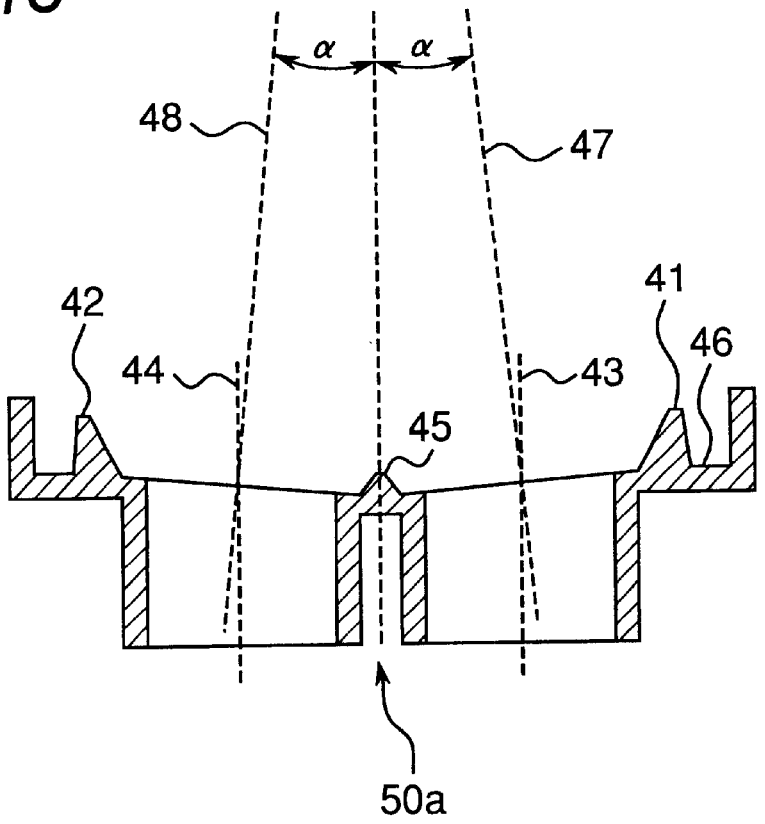
FIG. 13 is a sectional view of the double primary radiator according to the fourth embodiment of the present invention.

FIGS. 12 and 13 are a front elevational view and a sectional view of a double primary radiator according to a fourth embodiment of the present invention, respectively. As shown if FIG. 13, feed horns 41 and 42, groove portions 46 and a joint part 45 in a double primary radiator 50*a* have shapes similar to those of the double primary radiator 30*a* of FIG. 9. The double primary radiator 50*a* is different from the double primary radiator 30*a* in that straight lines 47 and 48 perpendicular to respective aperture faces have a point of intersection with waveguide axes 43 44 which are parallel to each other.

Figure 11:
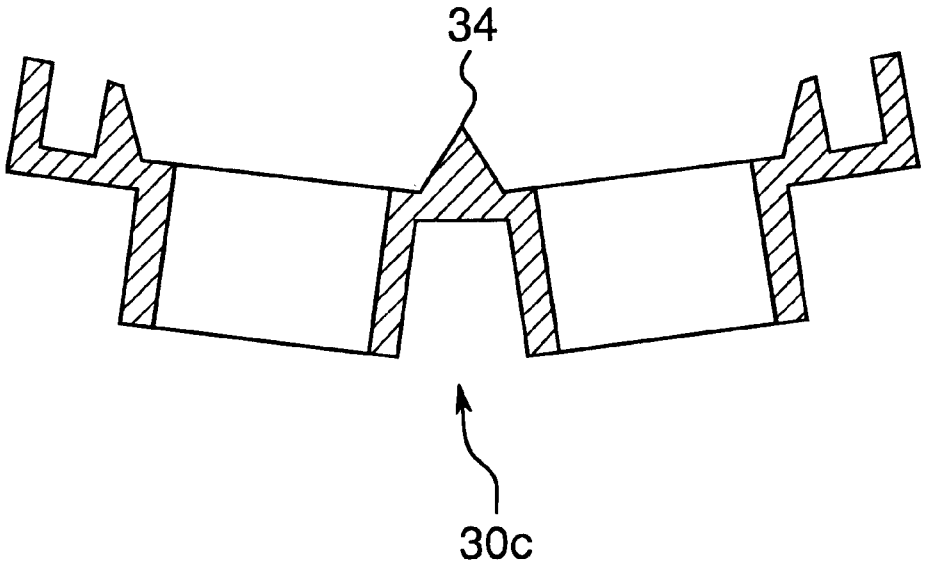
FIG. 11 is a sectional view of a still further double primary radiator according to the third embodiment of the present invention.

A construction similar to that of this embodiment may also be applied to the waveguides of the double primary radiators shown in FIGS. 10 and 11.

Figure 14:
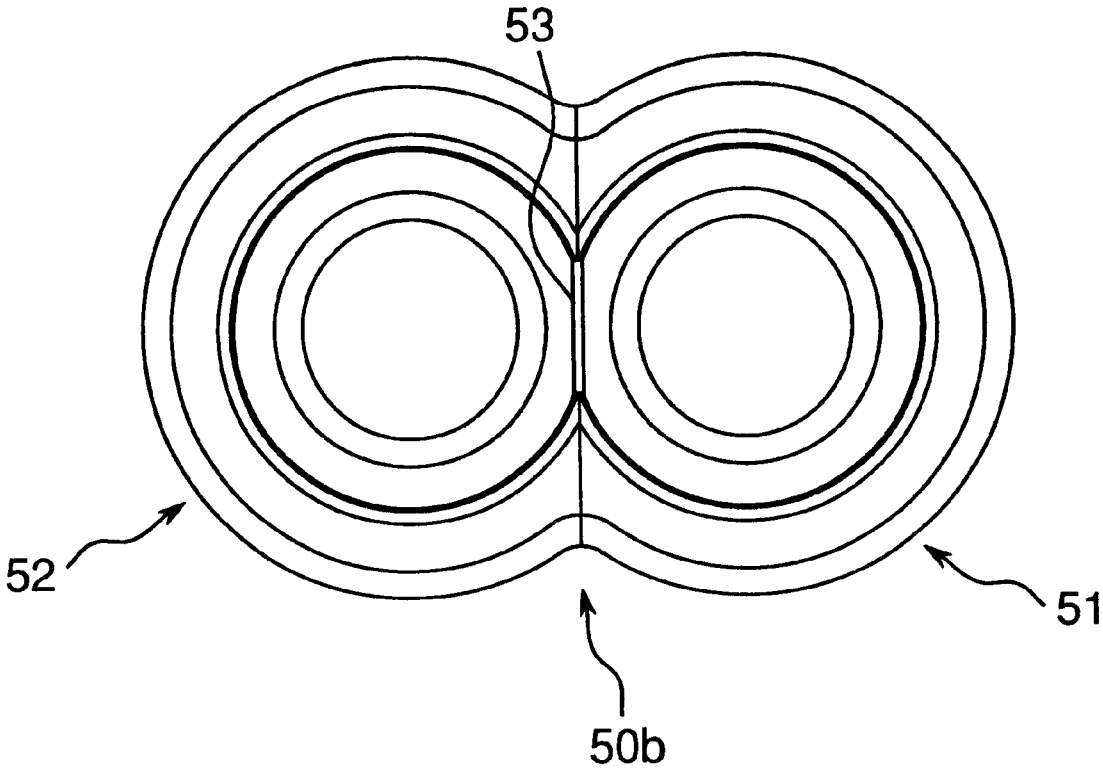
FIG. 14 is a front elevational view of a further double primary radiator according to the fourth embodiment of the present invention.
Figure 15:
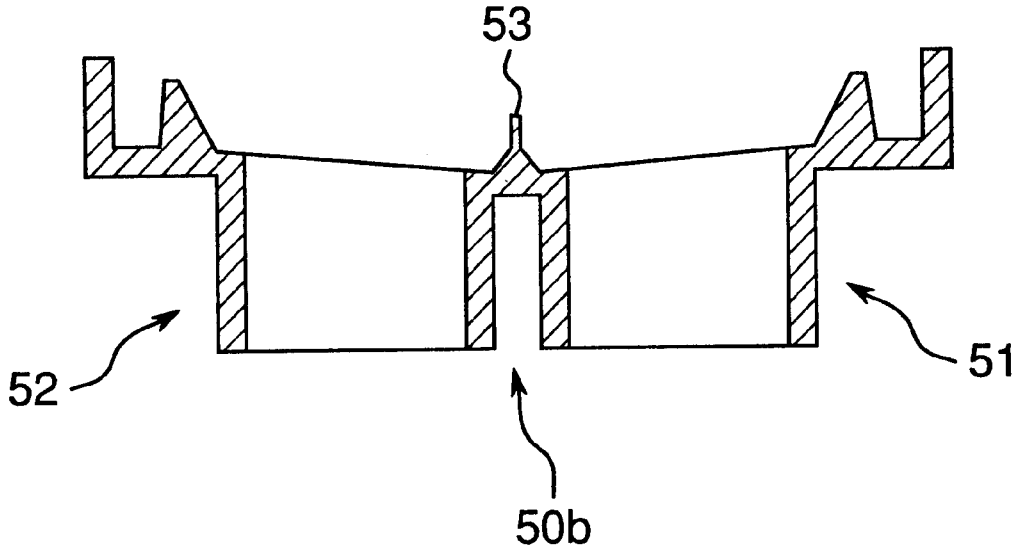
FIG. 15 is a sectional view of the further double primary radiator according to the fourth embodiment of the present invention.

FIGS. 14 and 15 are a front elevational view and a sectional view of a modified double primary radiator 50*b* of this embodiment, respectively. In the double primary radiator 50*b*, a partition member 53 having a predetermined thickness and a predetermined height is provided at a joint part so as to compensate for excised portions of the two feed horns at the joint part 45 of the double primary radiator 50*a*. The partition member 53 also has a tapered shape in the same manner as feed horns.

In this embodiment, since the partition member 53 compensates for the excised portions of the feed horns, it is possible to improve isolation performance in radio waves from two satellites. As a result, it is possible to prevent drop of antenna directivity at the time of incidence of radio waves subjected to horizontal polarization.

Meanwhile, in this embodiment, the double primary radiator has two parallel waveguide axes and therefore, can be obtained by a simple process such as injection molding employing a die.

All the double primary radiators of the above embodiments are arranged to receive radio waves from two satellites. Similarly, if a multi-primary radiator is employed in which primary radiators identical, in number, with satellites are coupled with one another such that centers of their apertures are arranged linearly, it is possible to receive radio waves from three or more satellites.

Fifth Embodiment

Figure 16:
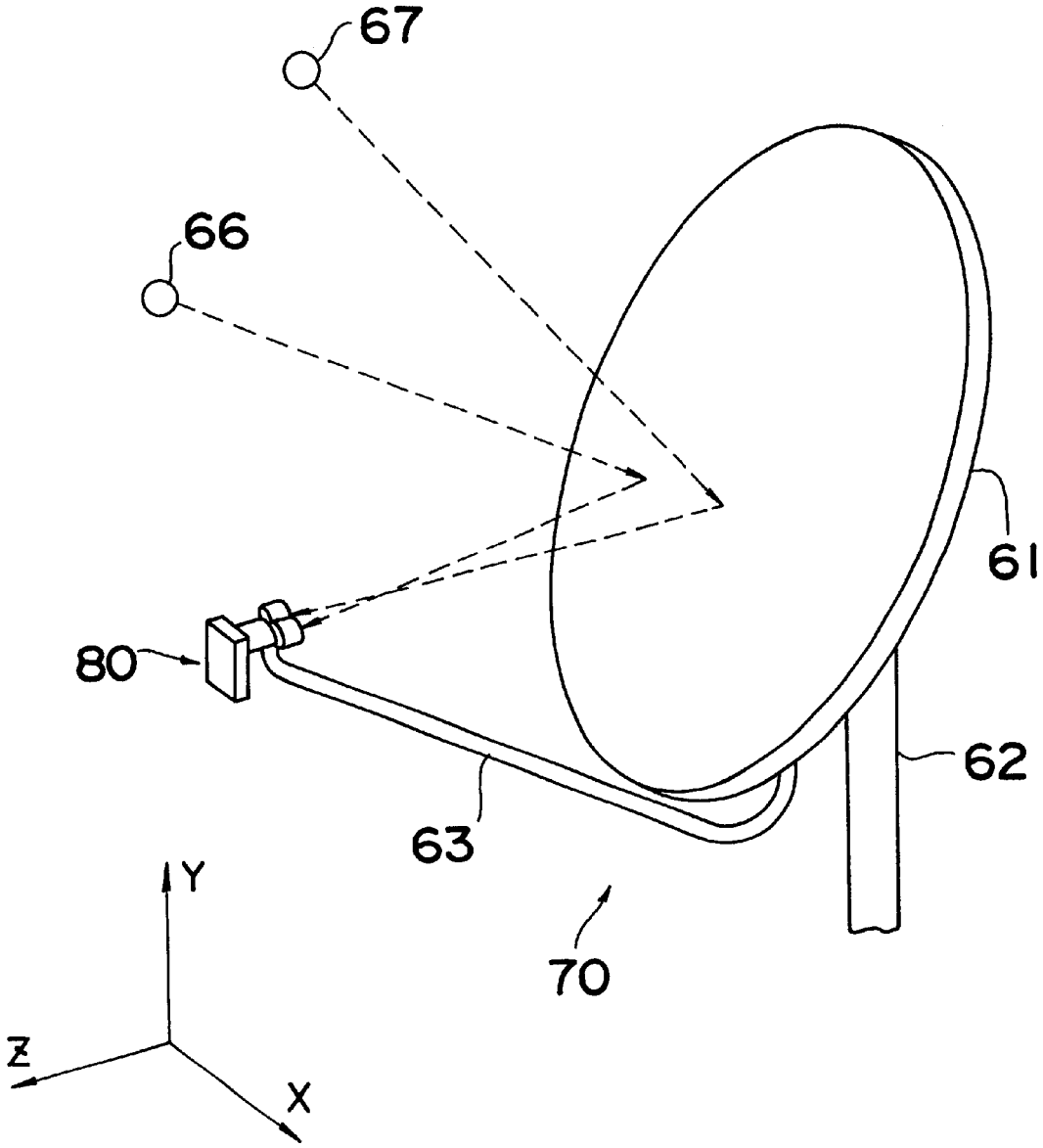
FIG. 16 is a perspective view of a dual-beam antenna of the present invention.

Hereinafter, a block-down-converter and a dual-beam antenna according to this embodiment of the present invention is described with reference to the drawings. FIG. 16 is a perspective view showing an arrangement of a block-down-converter including the above double primary radiator and a dual-beam antenna.

As shown in FIG. 16, a dual-beam antenna 70 is constituted by a parabolic reflector 61, a support mast 62, a support arm 63 and a block-down converter 80. Radio waves from satellites 66 and 67 are reflected by the reflector 61 so as to be received by the block-down-converter 80. Meanwhile, in coordinate axes shown in FIG. 16, the Y-axis represents a vertical direction, while the X-axis and the Z-axis represent lateral and longitudinal directions of the dual-beam antenna 70 on the surface of the earth, respectively.

Figure 17:
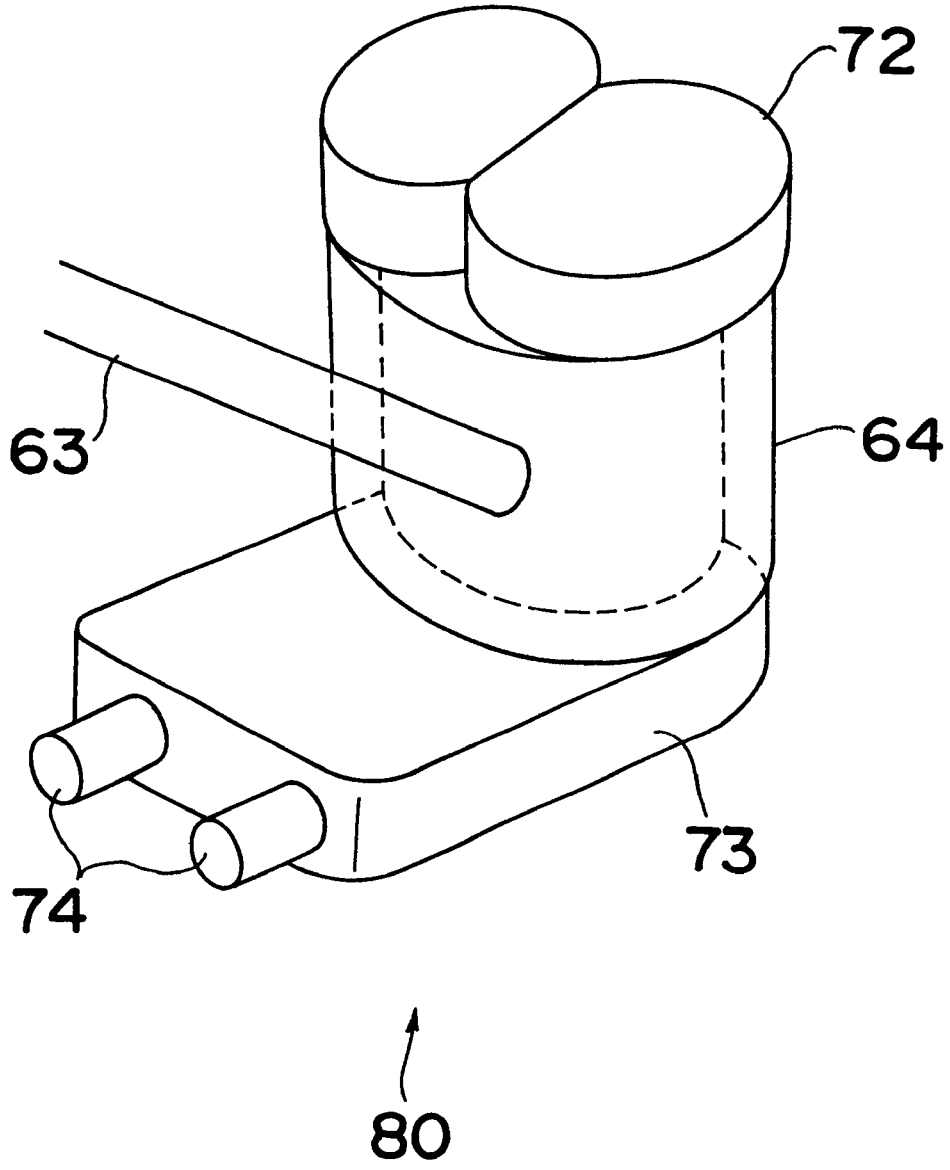
FIG. 17 is a perspective view of a block-down-converter of the present invention.

The block-down-converter 80 is schematically illustrated in FIG. 17. The block-down-converter receives radio waves from satellites by the double primary radiator and performs amplification and frequency conversion of the received radio waves. As shown in FIG. 17, the block-down-converter 80 is constituted by a double primary radiator 72 having an arrangement identical with that of the double primary radiator 50*b*, a housing 73 containing a conversion circuit for performing amplification and frequency conversion, an F-type connector 74 acting as an output terminal of the block-down-converter 80 and a holding member 64 which is attached to a distal end of the support arm 63 so as to fix the double primary radiator 72 to the support arm 63. The double primary radiator 72 and the housing 73 are integrally molded and therefore, can be produced by a simple process such as injection molding employing a die, thus resulting in reduction of the production cost.

Figure 18:
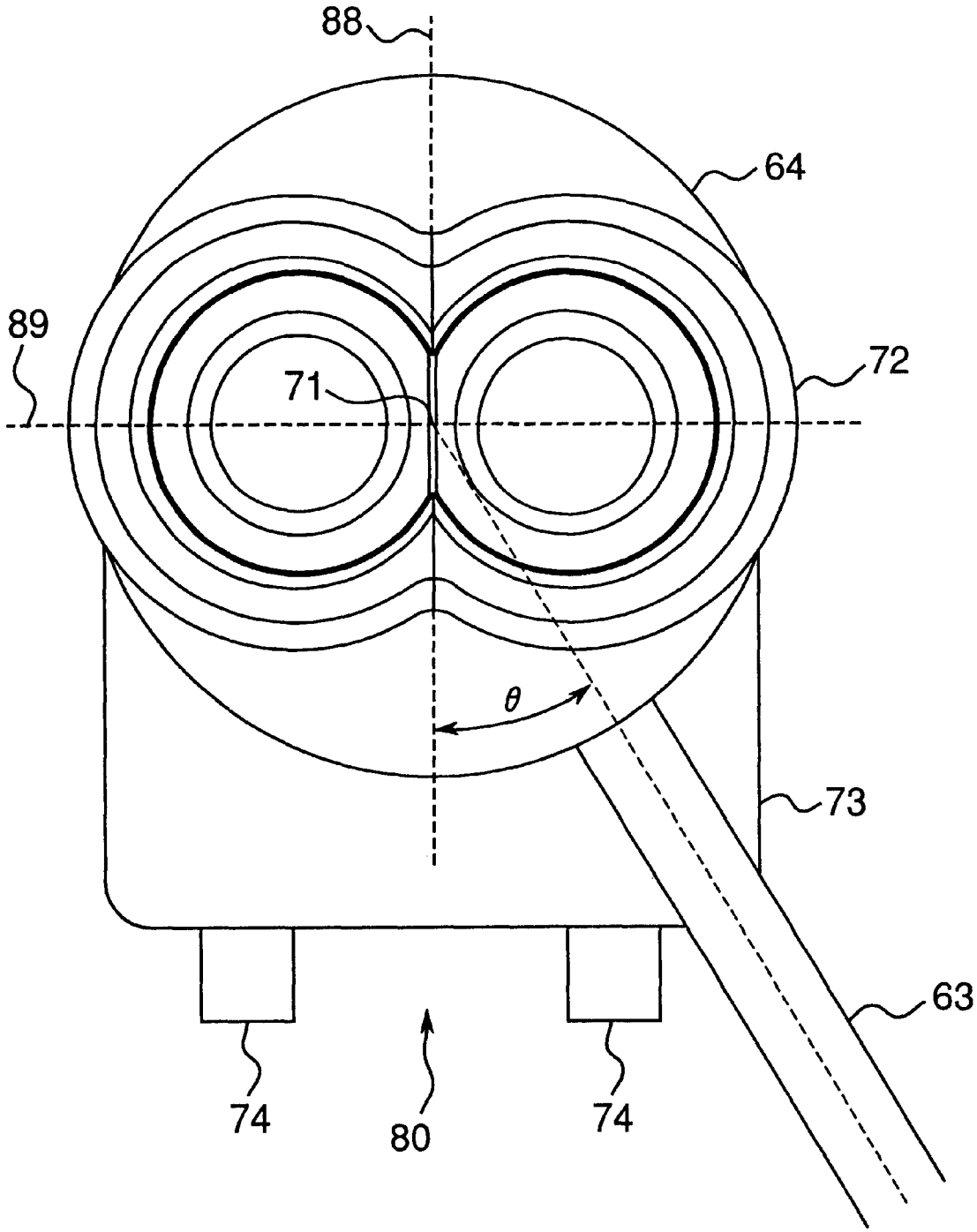
FIG. 18 is a front elevational view of the block-down-converter of the present invention.

FIG. 18 is a front elevational view of the block-down-converter 80. In FIG. 18, the construction of the holding member 64 enables the support arm 63 to be freely rotated about a central point 71 of a joint part, more specifically, a perpendicular radiation axis passing through the central point 71 of the joint part. An angle $\theta$ formed between a central line 88 of the joint part and the support arm 63 denotes an angle of inclination of the block-down-converter 80 as shown in FIG. 16 and is referred to as a "tilt angle" of the block-down-converter, hereinafter.

Meanwhile, in the block-down-converter 80, the central point 71 of the joint part, namely, a center of an aperture face of the double primary radiator 72 is disposed in the vicinity of a focal point of the reflector 61.

Hence, in the dual-beam antenna provided with the double primary radiator, centers of two apertures are actually slightly spaced away from the focal point of the reflector and therefore, are set to a state of so-called "defocus". In order to solve this problem, the double primary radiator 72 has a construction in which apertures of two primary radiators face each other inwardly, so that reduction of radiation area by the defocus is compensated for.

Figure 19:
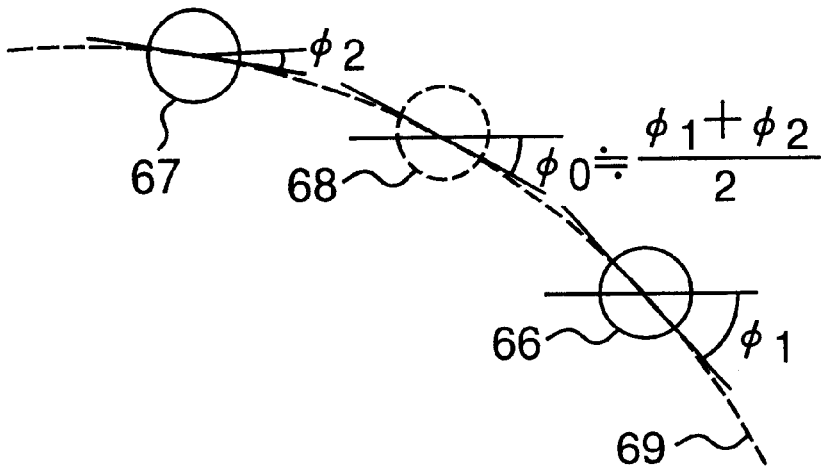
FIG. 19 is a view indicative of installation direction of the block-down-converter of the present invention.
Figure 19:
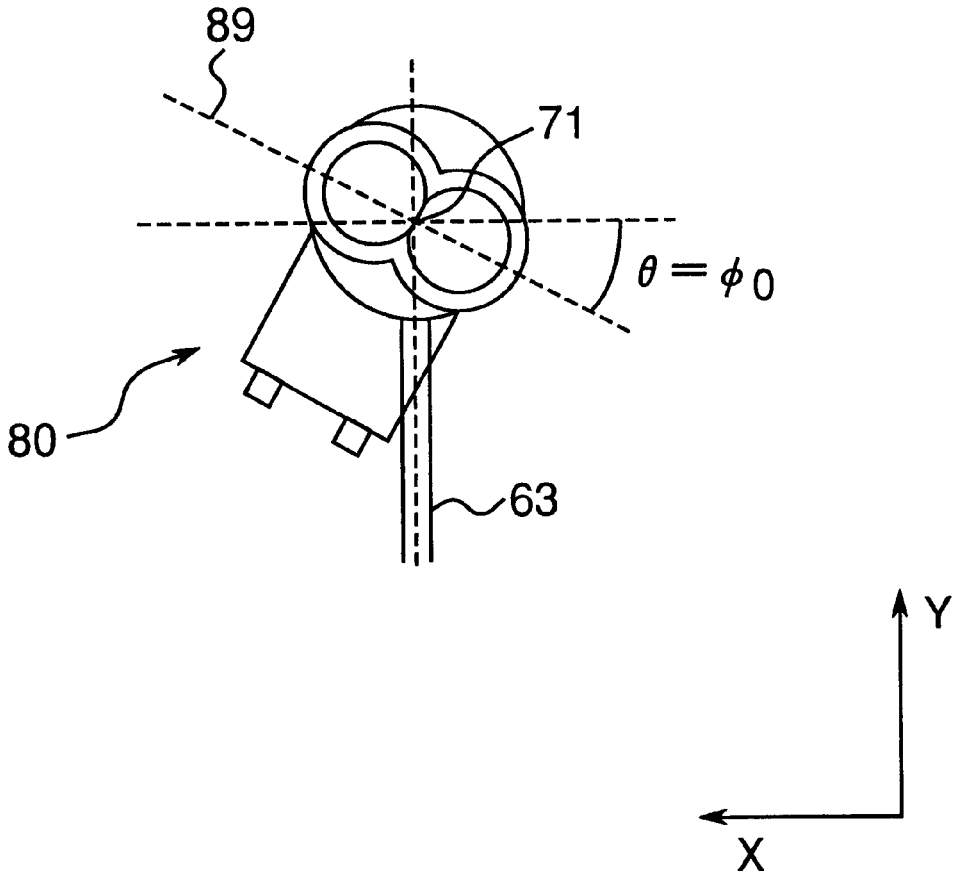
Figure 20:
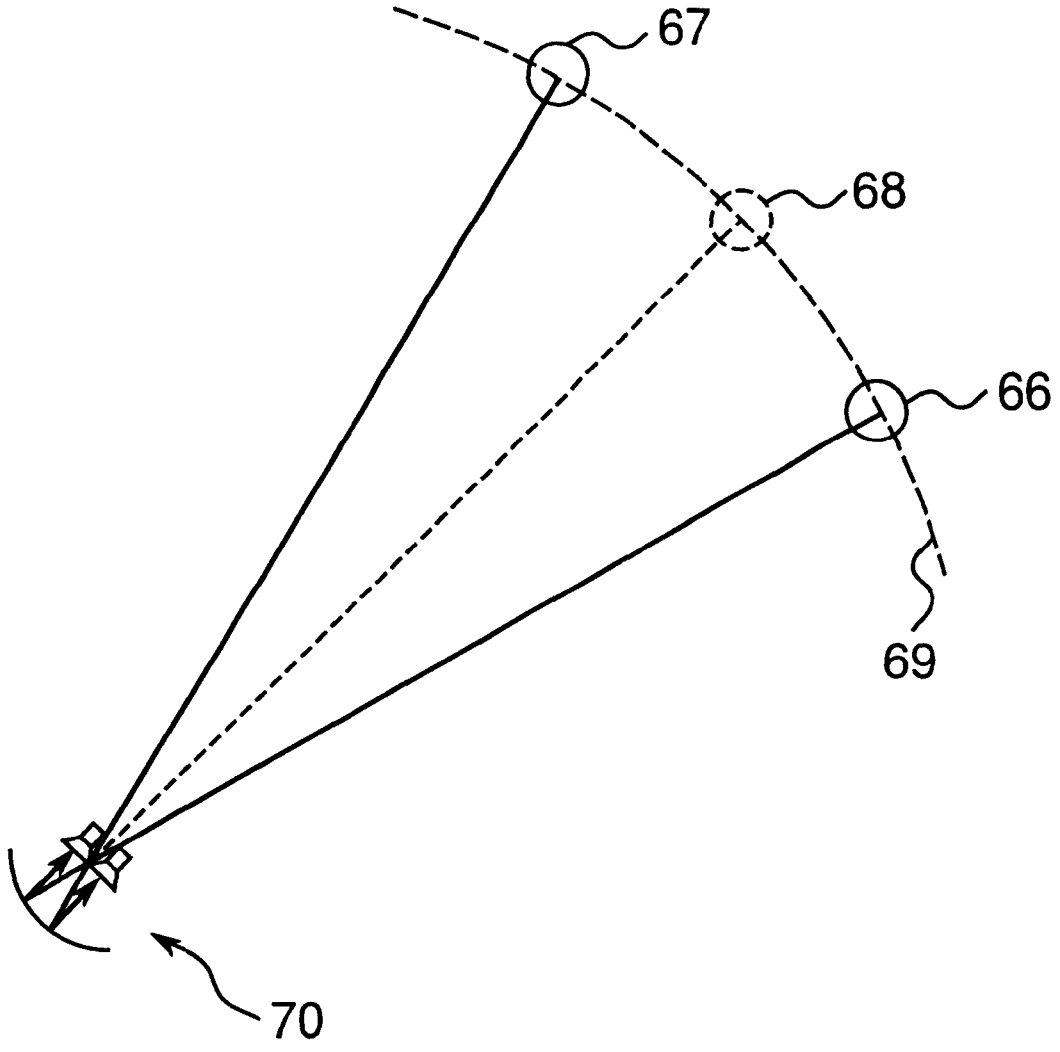
FIG. 20 is a view indicative of installation direction of the dual-beam antenna of the present invention.

FIGS. 19 and 20 are views showing in which directions the block-down-converter 80 and the dual-beam antenna 70 are installed relative to the satellites. In FIG. 19, the block-down-converter 80 is installed such that the aperture of the double primary radiator 72 is directed towards the reflector 61 (not shown). At a receiving point, $\phi 1$ and $\phi 2$ denote polarization angles of radio waves from the satellites 66 and 67 located on a stationary orbit 69, respectively. Meanwhile, as shown in FIG. 20, the reflector 61 is directed towards an imaginary satellite 68.

Adjustment of the tilt angle $\theta$ relative to polarization angles of radio waves from the two satellites is described, hereinafter. Initially, the imaginary satellite 68 for transmitting radio waves having a polarization angle $\phi 0$ is supposed to be located on the stationary orbit 69. Since a radius of the stationary orbit of the satellites is far larger than the radius of the earth, more specifically, the equator, the imaginary polarization angle $\phi 0$ is nearly equal to a mean of $\phi 1$ and $\phi 2$, namely, an angle formed between a straight line connecting the satellites 66 and 67 and the X-axis. In this embodiment, the block-down-converter 80 is installed such that the tilt angle $\theta$ becomes equal to the imaginary polarization angle $\phi 0$.

Figure 21:
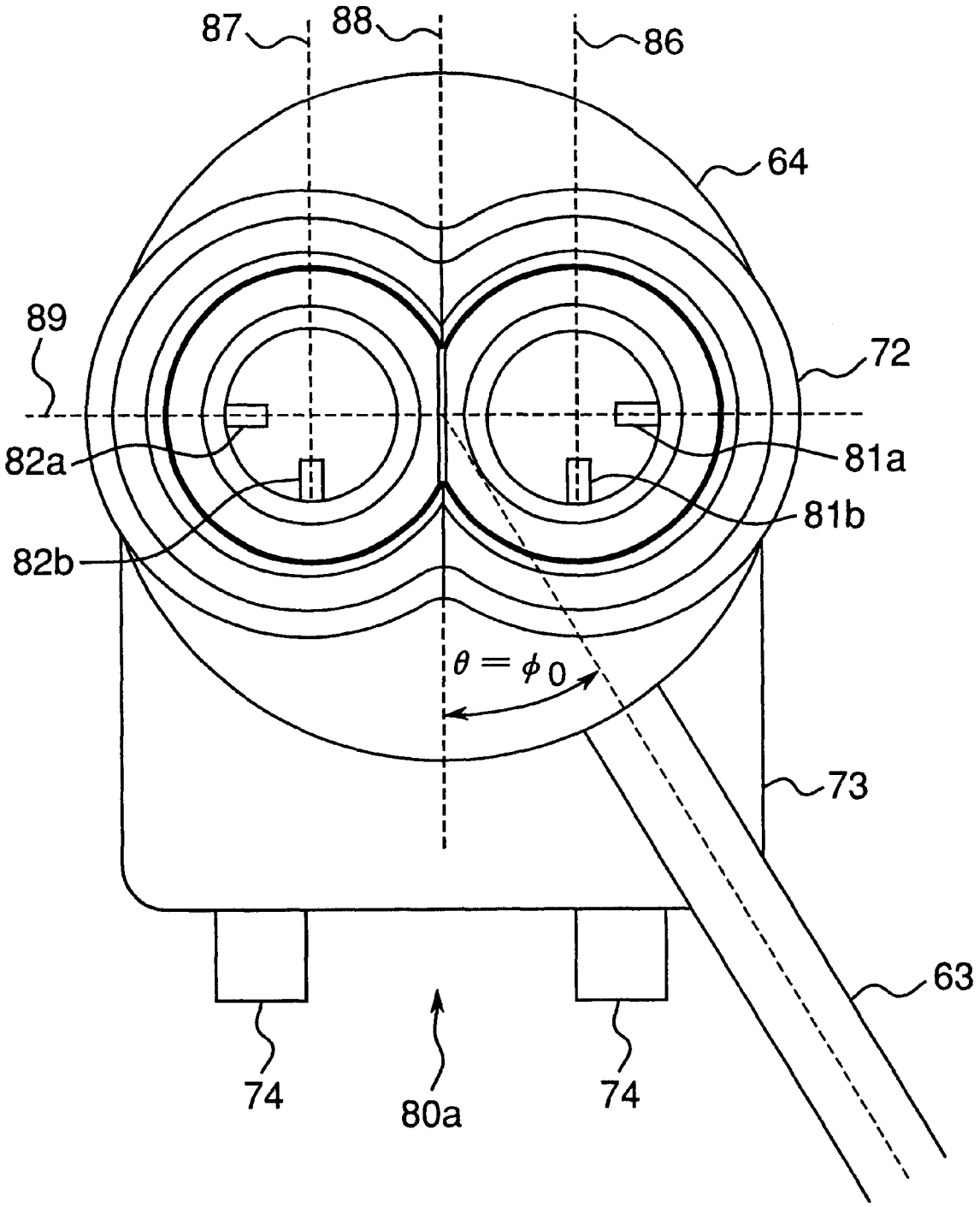
FIG. 21 is a front elevational view of a block-down-converter according to a fifth embodiment of the present invention.

FIG. 21 is a front elevational view of a block-down-converter 80*a* having $\theta$ in the same manner as in FIGS. 18 and 19. FIG. 21 illustrates a state of feeding elements 81*a*, 81*b*, 82*a* and 82*b* formed on the conversion circuit in the housing 73 located at an output side of the circular waveguides. These four feeding elements are each formed by a microstrip line having a predetermined length and a predetermined width.

As shown in FIG. 21, the feeding elements 81*a* and 82*a* are formed on a straight line 89 connecting centers of the two apertures, while the feeding elements 81*b* and 82*b* are, respectively, formed on straight lines 86 and 87 passing through the centers of the two apertures perpendicularly to the central line 89 of the apertures. Namely, the feeding elements 81*a* and 81*b* extend orthogonally to each other, while the feeding elements 82*a* and 82*b* extend orthogonally to each other. The four feeding elements as a whole are formed symmetrically with respect to a central line 88 of the joint part.

In this embodiment, since the two primary radiators and the housing of the block-down-converter 80*a* are integrally molded as described above, the block-down-converter 80*a* can be rotated about the perpendicular radiation axis of the double primary radiator and thus, the tilt angle can be adjusted simply.

For radio waves transmitted from the satellites, a measure of reducing the tilt angle $\theta$ for effecting adjustment of the polarization angle at a receiving area may be preliminarily taken. As this measure, a method is employed in which a predetermined polarization angle called a "slant angle" is preliminarily added, as an offset, to radio waves to be transmitted. In this case, an imaginary polarization angle is calculated by adding the slant angle to the polarization angle $\phi 1$ or $\phi 2$.

Meanwhile, if a multi-primary radiator including primary radiators identical, in number, with satellites is utilized, it is possible to form a multi-beam antenna for receiving radio waves from three or more satellites. Meanwhile, each pair of the feeding elements should include at least a feeding element for vertical polarization and a feeding element for horizontal polarization and may include three or more feeding elements.

Sixth Embodiment

Figure 22:
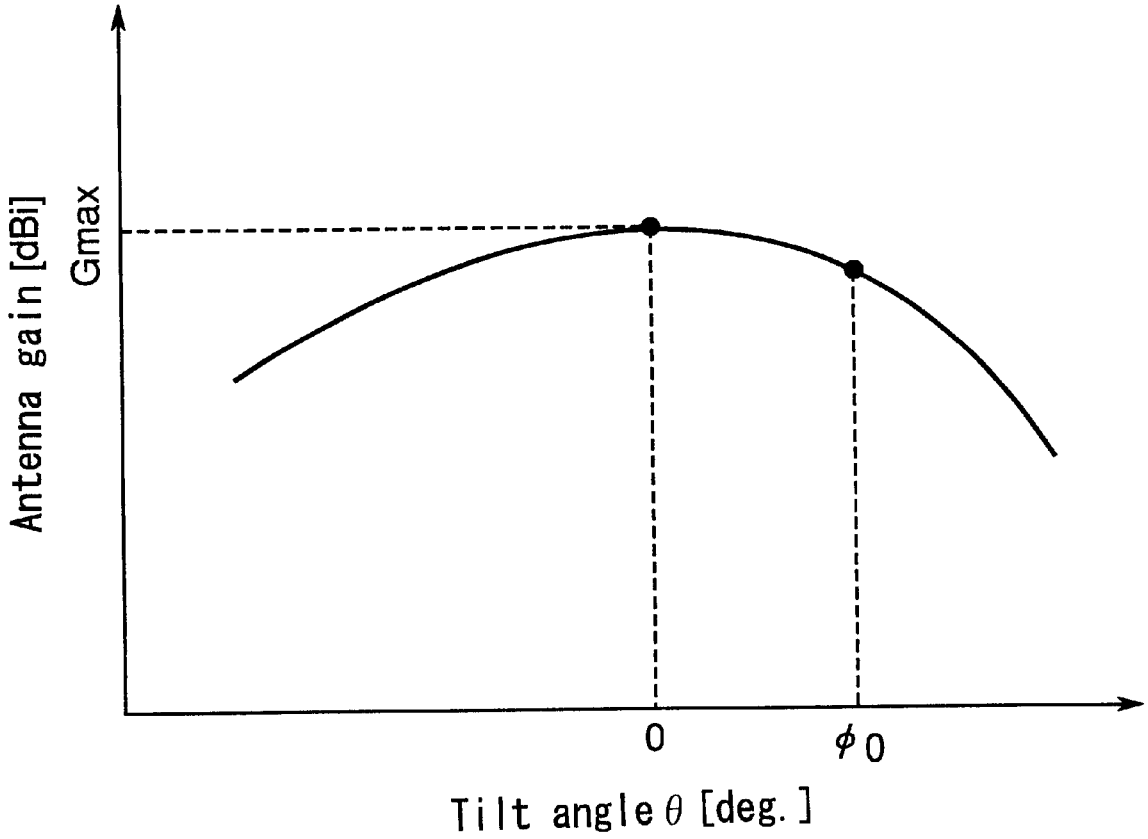
FIG. 22 is a graph showing relationship between tilt angle θ and antenna gain G.

FIG. 22 is a graph showing a relationship between tilt angle $\theta$ and antenna gain G. In case the polarization angle is adjusted by the tilt angle $\theta$ of the converter as described above, antenna gain G drops strikingly when the tilt angle $\theta$ is excessively large.

Figure 23:
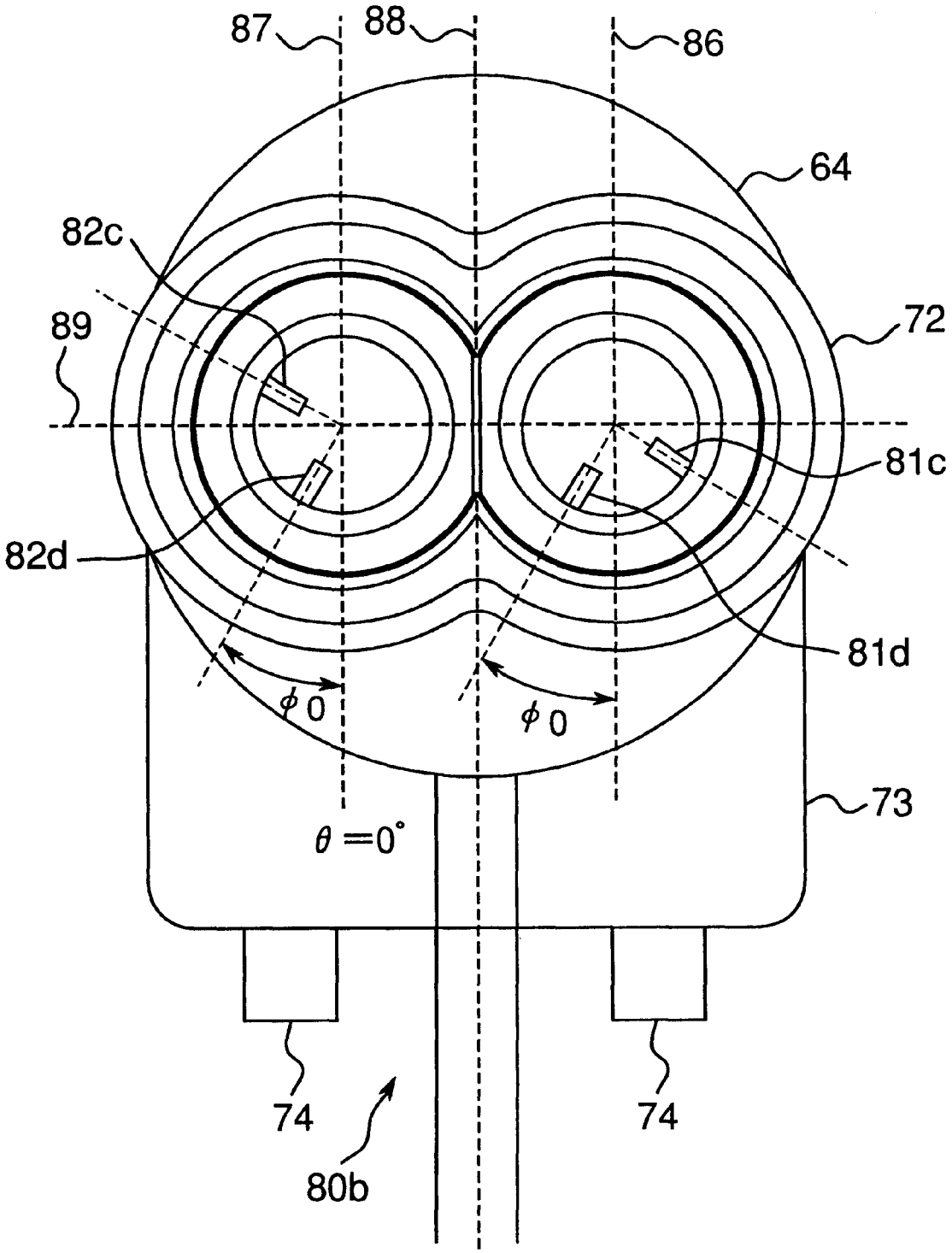
FIG. 23 is a front elevational view of a block-down-converter according to a sixth embodiment of the present invention.

In order to solve this problem, the tilt angle $\theta$ is set to 0 degrees and, two pairs of feeding elements 81*c* and 81*d* and feeding elements 82*c* and 82*d* are formed at such positions as to be rotated through the angle $\theta$ about centers of respective apertures as in a block-down-converter 80*b* shown in FIG. 23.

As will be seen from the above, the polarization angle can be adjusted without incurring deterioration of antenna gain in this embodiment.

Seventh Embodiment

Figure 24:
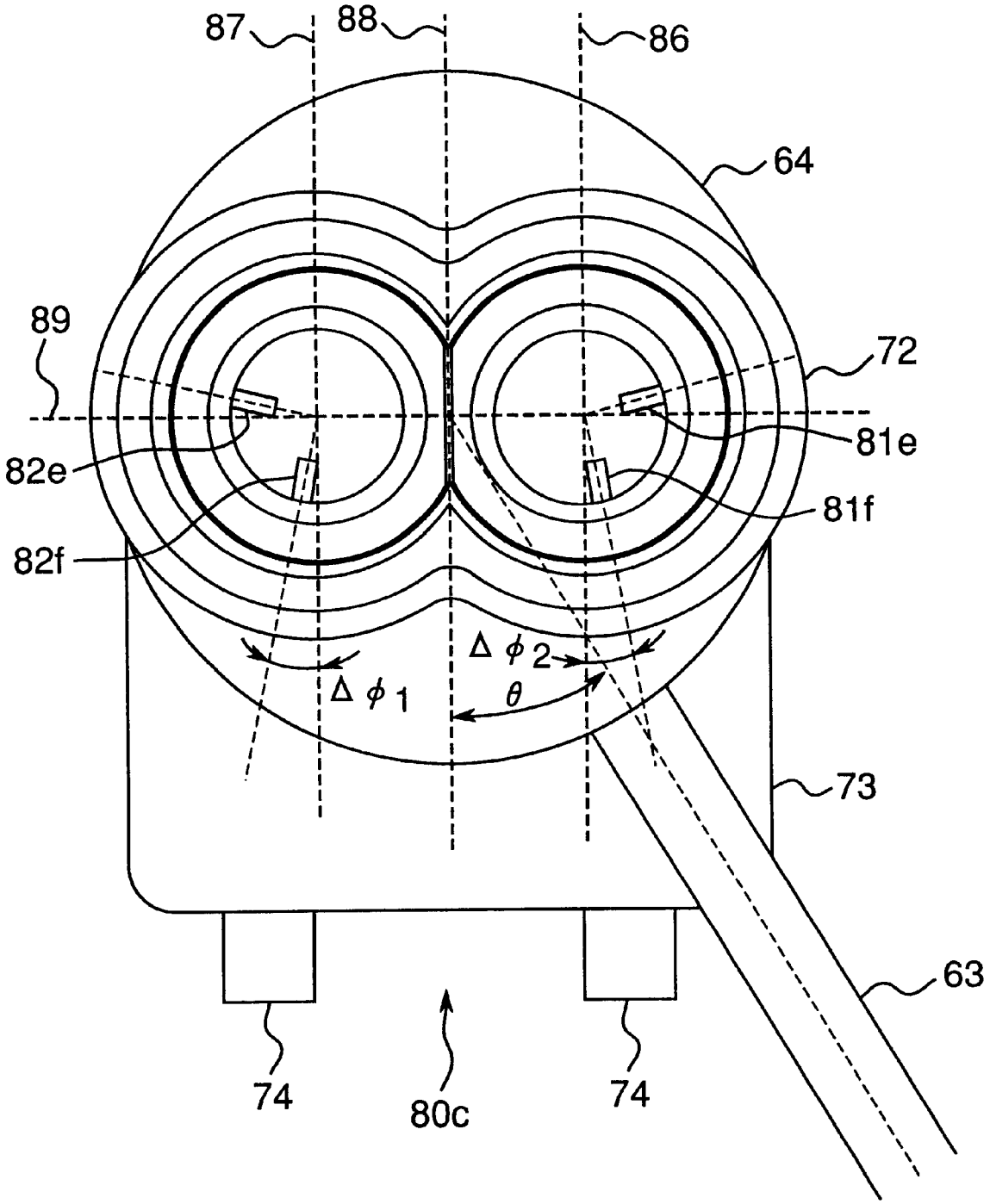
FIG. 24 is a front elevational view of a block-down-converter according to a seventh embodiment of the present invention.

FIG. 24 is a front elevational view of a block-down-converter 80*c*. In FIG. 24, a pair of feeding elements 81*e* and 81*f* are formed orthogonally to each other so as to be rotated counterclockwise through an initial tilt angle $\Delta\phi 2$ relative to the straight line 86, while a pair of feeding elements 82*e* and 82*f* are formed orthogonally to each other so as to be rotated clockwise through an initial shift angle $\Delta\phi 1$ relative to the straight line 87. In the same manner as the tilt angle, these initial shift angles are determined based on a point-located at a center of a longitudinal range of an area capable of receiving radio waves or a target receiving area, for example, "Shizuoka" in the case of Japan. Usually, $\Delta\phi 1$ and $\Delta\phi 2$ are equal to each other. However, in case transmitted radio waves contain the slant angle, the initial shift angles $\Delta\phi 1$ and $\Delta\phi 2$ amount to angles obtained by adding the slant angle thereto.

Figure 25:
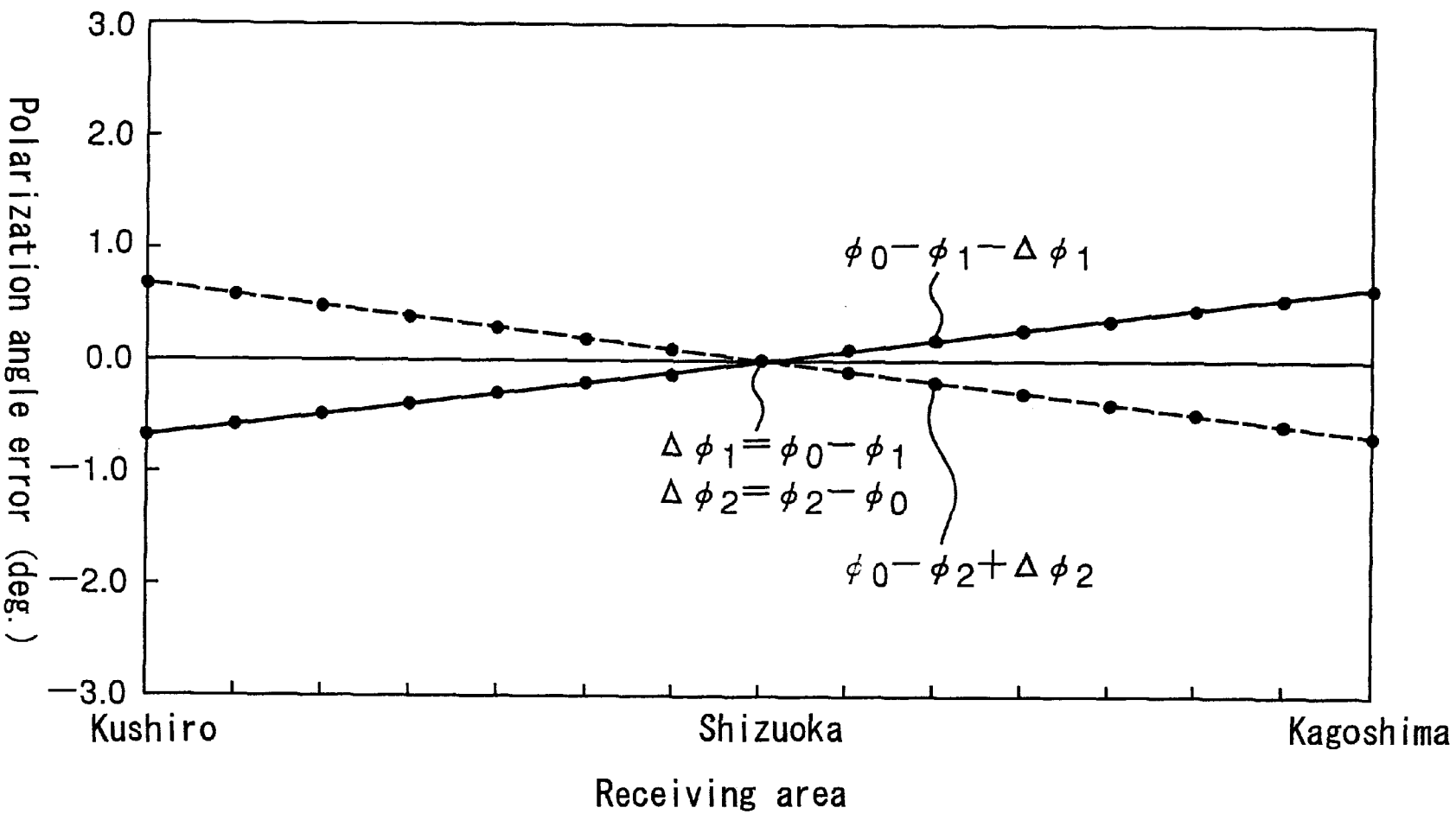
FIG. 25 is a graph showing polarization adjustment error produced at the time initial shift angle has been set to an optimum value.

FIG. 25 is a graph showing polarization adjustment error, in which the initial shift angles $\Delta\phi 1$ and $\Delta\phi 2$ are set to optimum values in Japan on the supposition that the satellites 66 and 67 are the JCSAT-3 (128° of east longitude) and the JCSAT-4 (124° of east longitude), respectively.

As shown in FIG. 25, supposing that "Kushiro" and "Kagoshima" are an easternmost end and a westernmost end of the receiving area, respectively, "Shizuoka" is located substantially at a center of its longitudinal range. Therefore, by using the polarization angles $\phi 1$ and $\phi 2$ and the imaginary polarization angle $\phi 0$ in Shizuoka, the initial shift angles $\Delta\phi 1$ and $\Delta\phi 2$ are, respectively, calculated from ($\Delta\phi=\phi 0-\phi 1$) and ($\Delta\phi 2=\phi 2-\phi 0$). In this embodiment, the initial shift angles assume about 2.5 degrees. In this way, each of polarization adjustment errors ($\phi 0-\phi 1-\Delta\phi 1$) and ($\phi 0-\phi 2+\Delta\phi 2$) for the satellites 66 and 67 can be restricted within ±1 degree at each receiving point in Japan.

In this embodiment, since the initial shift angle for adjusting the polarization angle is set to that of the point located at the center of the longitudinal range of the receiving area, adjustment of the initial shift angle can be substantially optimized in the whole receiving area. Therefore, since it is not necessary to adjust the initial shift angle at each receiving area, the block-down-converter can be mass produced.

Meanwhile, since the block-down-converter 80*c* can be rotated about the perpendicular radiation axis of the double primary radiator, the tilt angle can be adjusted simply.

Eighth Embodiment

Figure 26:
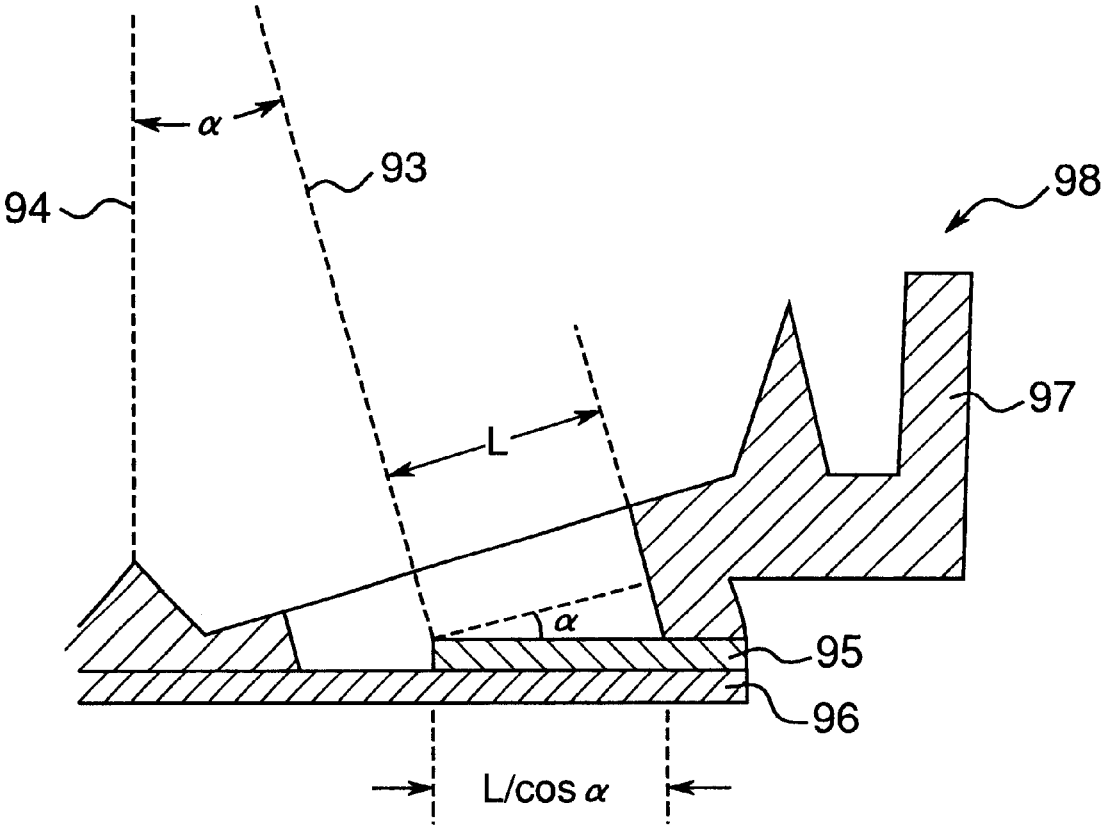
FIG. 26 is a sectional. view of a block-down-converter according to an eighth embodiment of the present invention.
Figure 27:
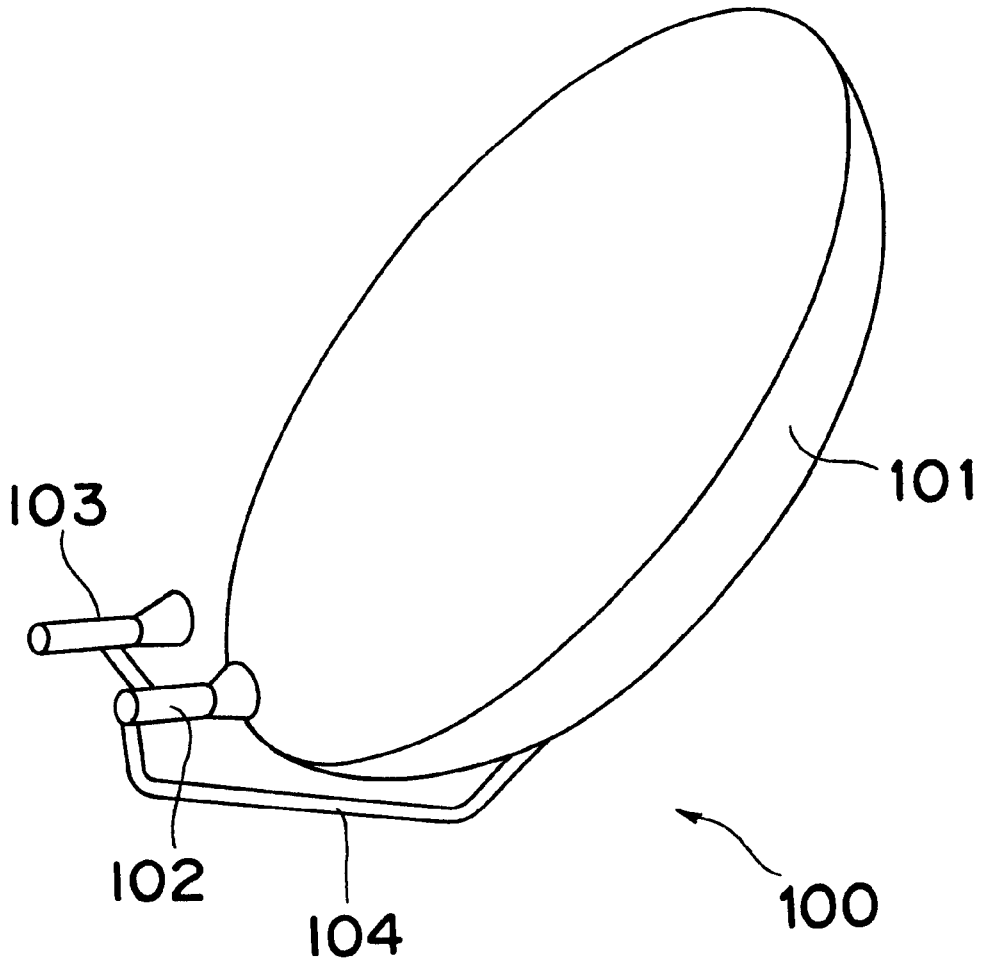
FIG. 27 is a perspective view of a conventional parabolic antenna.
Figure 28:
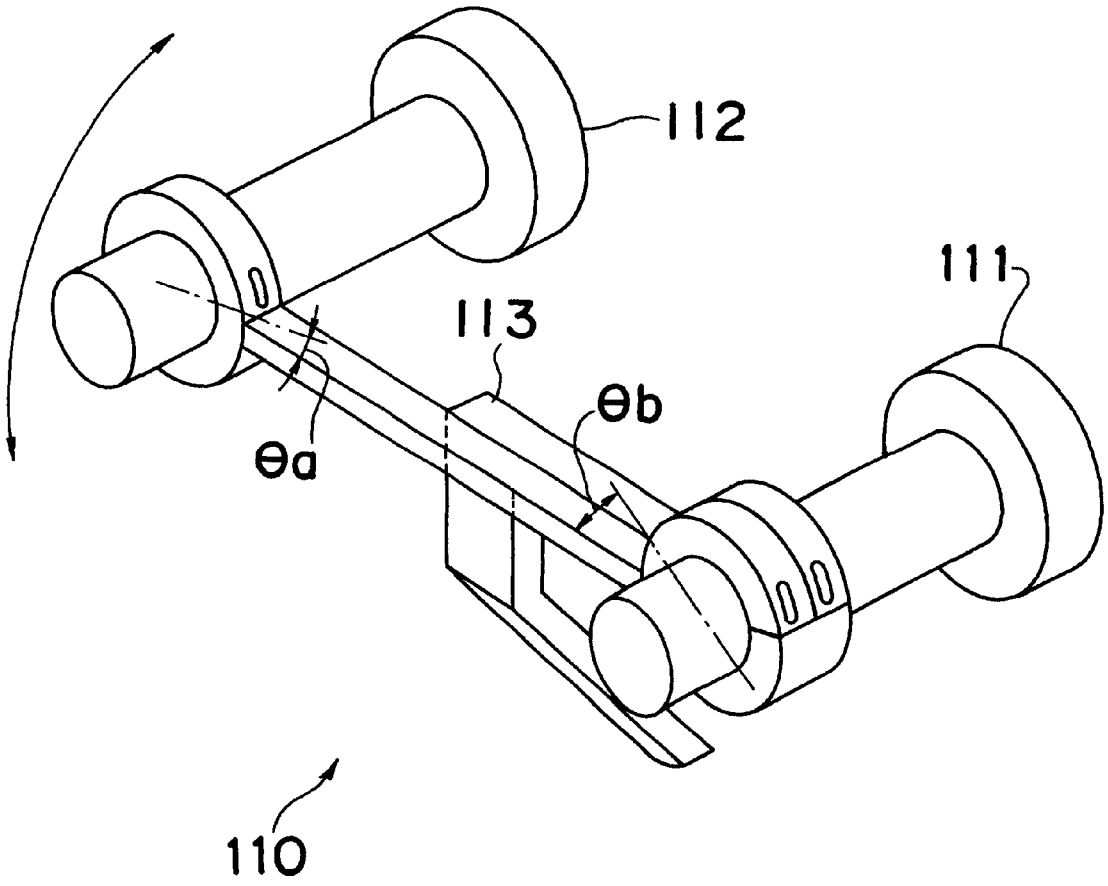
FIG. 28 is a perspective view of a conventional double primary radiator.
Figure 29:
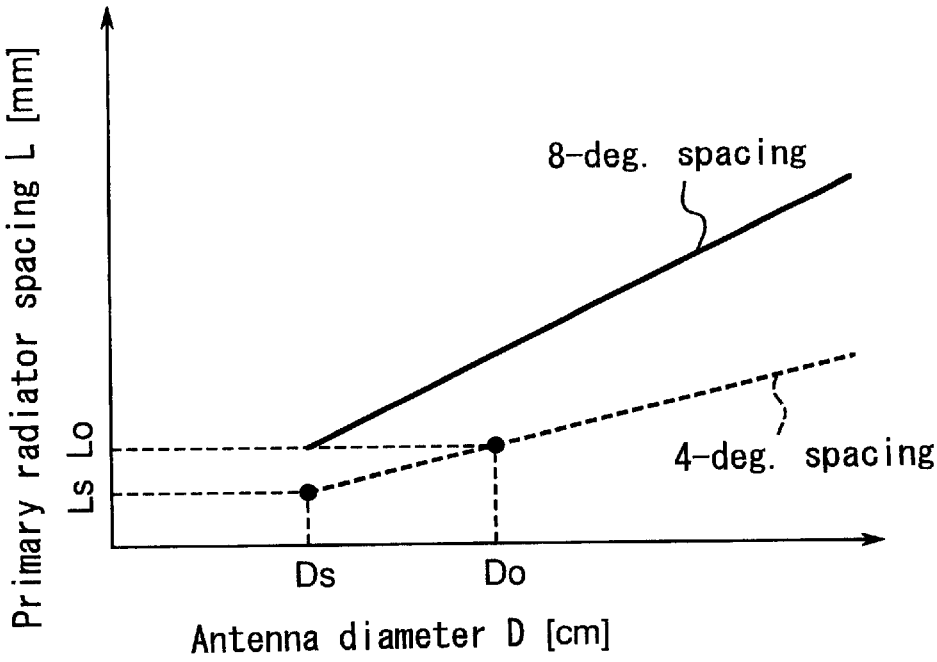
FIG. 29 is a graph showing a relationship between antenna diameter D and primary radiator spacing L.
Figure 30:
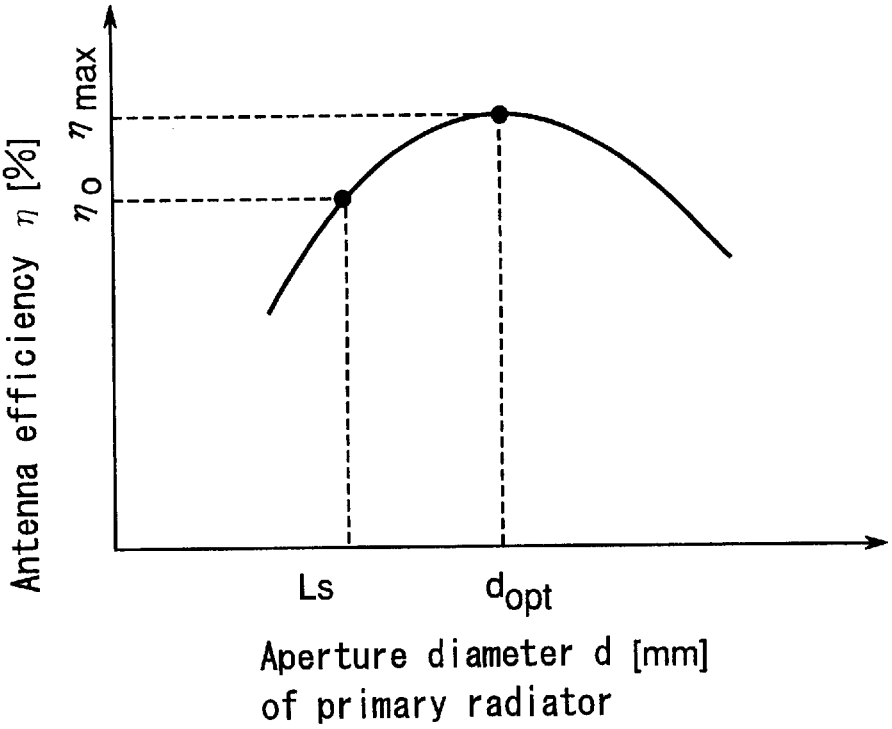
FIG. 30 is a graph showing relation between aperture diameter d of a primary radiator and antenna efficiency η.

FIG. 26 is a sectional view of a block-down-converter 98. In FIG. 26, the block-down-converter 98 is constituted by a double primary radiator 97 having apertures similar to those of the double primary radiator 30*a* and a printed board 96 on which a conversion circuit is formed. A feeding element 95 is formed on the printed board 96 and the printed board 96 is mounted on an output side of the double primary radiator 97. Meanwhile, the double primary radiator 97 is different from the double primary radiator 30*a* in that no waveguide is provided. A straight line 93 is perpendicular to an aperture face.

As shown in FIG. 26, the aperture of the double primary radiator 97 is formed such that the straight line 93 and a perpendicular radiation axis 94 form an angle $\alpha$. As a result, the aperture face and the printed board 96 form the angle $\alpha$. The printed board 96 is mounted orthogonally to the perpendicular radiation axis 94.

This embodiment is characterized in that a length of the feeding element 95 assumes ($L/\cos\alpha$) obtained by projecting onto the printed board along the straight line 93 a length L of a feeding element which might be formed in parallel with the aperture face.

In accordance with this embodiment, since the waveguides can be eliminated without reducing radiation area of radio waves, the block-down-converter can be made more compact.

INDUSTRIAL APPLICABILITY

In accordance with the present invention, the parabolic antenna capable of receiving vertical polarized waves and horizontal polarized waves simultaneously can be made compact and light by maintaining antenna efficiency. Thus, it is possible to materialize a high-performance parabolic antenna for general home use, which includes a small-diameter reflector having an effective diameter of, for example, 45 cm. If this parabolic antenna is used in, for example, Japan, it is possible to receive radio waves from the JCSAT-3 (128° of east longitude) and the JCSAT-4 (124° of east longitude).

What is claimed is:

1. A block-down-converter for receiving radio waves from at least two satellites, comprising:

a first primary radiator having a first peripheral portion that defines a first aperture and includes a first cutoff portion;

a second primary radiator have first and second cutoff portions, respectively having a second peripheral portion that defines a second aperture and includes a second cutoff portion, with said first cutoff portion and said second cutoff portion being joined to one another to form a joint part in which the first and second cutoff potons are joined sith each other; and a single housing containing a single conversion circuit that includes at least one feeding element, said single conversion circuit for receiving at least two radio waves and performing amplification and frequency conversion of the received radio waves.

2. The block-down-converter according to claim 1, wherein said first peripheral portion includes a first feed horn and said second peripheral portion includes a second feed horn.

3. The block-down-converter according to claim 2, wherein said first peripheral portion includes a first groove portion such that said first feed horn is positioned between said first groove portion and said first aperture, and said second peripheral portion includes a second groove portion such that said second feed horn is positioned between said second groove portion and said second aperture.

4. The block-down-converter according to claim 3, wherein said first groove portion and said second groove portion are joined to one another at said joint part.

5. The block-down-converter according to claim 2, wherein said first feed horn and said second feed horn are joined to one another at said joint part, and further comprising a partition member at said joint part.

6. The block-down-converter according to claim 1, wherein said first aperture has a first aperture face and said second aperture has a second aperture face, such that a first axis passing through a center of said first aperture perpendicularly to said first aperture face intersects a second axis passing through a center of said second aperture perpendicularly to said second aperture face.

7. The block-down-converter according to claim 6, wherein said first primary radiator includes a first waveguide having a first waveguide axis and said second primary radiator includes a second waveguide having a second waveguide axis, with said first waveguide axis being parallel to said second waveguide axis.

8. The block-down-converter according to claim 1, wherein said first aperture has a first aperture face and said second aperture has a second aperture face, and said at least one feeding element forms an angle with said first aperture face or said second aperture face such that a length of said at least one feeding element is obtained by projecting a length that is parallel to said first aperture face or said second aperture face onto said conversion circuit along a direction that is perpendicular to said first aperture face or said second aperture face.

9. The block-down-converter according to claim 1, wherein said at least one feeding element includes at least two feeding elements for each of said first primary radiator and said second primary radiator, with two of said at least two feeding elements forming a right angle with one another.

10. The block-down-converter according to claim 9, wherein said joint part has a central axis, and at least one of said at least two feeding elements forms a predetermined angle with the central axis of said joint part.

11. The block-down-converter according to claim 10, wherein the predetermined angle is substantially equal to an imaginary polarization angle at a point on a predetermined longitude.

12. The block-down-converter according to claim 11, wherein the predetermined longitude is located substantially at a center of a predetermined longitudinal range.

13. The block-down-converter according to claim 11, wherein the predetermined angle is an angle calculated by using a slant angle of the radio waves.

14. The block-down-converter according to claim 10, wherein the predetermined angle is substantially equal to a difference at a point on a predetermined longitude between an imaginary polarization angle and a polarization angle of radio waves emitted from one of the at least two satellites.

15. The block-down-converter according to claim 14, wherein the predetermined longitude is located substantially at a center of a predetermined longitudinal range.

16. The block-down-converter according to claim 14, wherein the predetermined angle is an angle calculated by using a slant angle of the radio waves.

17. A multi-beam antenna comprising:

a block-down-converter for receiving radio waves from at least two satellites, said block-down-converter including (i) a first primary radiator having a first peripheral portion that defines a first aperture and includes a first cutoff portion;

(ii) a second primary radiator having a second peripheral portion that defines a second aperture and includes a second cutoff portion, with said first cutoff portion and said second cutoff portion being joined to one another to form a joint part; and (iii) a single housing containing a single conversion circuit that includes at least one feeding element, said single conversion circuit for receiving at least two radio waves and performing amplification and frequency conversion of the received radio waves;

a reflector for reflecting the radio waves; and a support arm for coupling said block-down-converter and said reflector with each other.

18. The multi-beam antenna according to claim 17, wherein a tilt angle of said block-down-converter is variable.

19. The multi-beam antenna according to claim 18, further comprising a holding member for coupling said support arm and said block-down-converter with each other so as to make the tilt angle of said block-down-converter variable about a perpendicular radiation axis.

* * * * *